US011199170B2

(12) United States Patent
Funato et al.

(10) Patent No.: US 11,199,170 B2
(45) Date of Patent: Dec. 14, 2021

(54) IGNITION CONTROL DEVICE

(71) Applicant: DENSO CORPORATION, Kariya (JP)

(72) Inventors: Ippei Funato, Kariya (JP); Akimitsu Sugiura, Kariya (JP); Kanechiyo Terada, Kariya (JP)

(73) Assignee: DENSO CORPORATION, Kariya (JP)

( * ) Notice: Subject to any disclaimer, the term of this patent is extended or adjusted under 35 U.S.C. 154(b) by 142 days.

(21) Appl. No.: 16/288,520

(22) Filed: Feb. 28, 2019

(65) Prior Publication Data

US 2019/0271290 A1 Sep. 5, 2019

(30) Foreign Application Priority Data

Mar. 1, 2018 (JP) ..... JP2018-036868

(51) Int. Cl.

| | |
|---|---|
| ***F02P 17/12*** | (2006.01) |
| ***F02P 15/10*** | (2006.01) |
| ***F02P 9/00*** | (2006.01) |
| ***F02P 3/08*** | (2006.01) |
| ***F02D 35/02*** | (2006.01) |
| ***F02B 75/02*** | (2006.01) |
| ***F02P 3/05*** | (2006.01) |

(52) U.S. Cl.

CPC ..... *F02P 17/12* (2013.01); *F02B 75/02* (2013.01); *F02D 35/021* (2013.01); *F02P 3/05* (2013.01); *F02P 3/08* (2013.01); *F02P 9/007* (2013.01); *F02P 15/10* (2013.01); *F02P 2017/121* (2013.01)

(58) Field of Classification Search

CPC ..... F02P 15/10; F02P 17/12; F02P 2017/121; F02P 3/0442; F02P 3/05; F02P 3/08; F02P 9/007; H01T 13/60

See application file for complete search history.

(56) References Cited

U.S. PATENT DOCUMENTS

| | | | | |
|---|---|---|---|---|
| 2017/0284358 | A1* | 10/2017 | Skowronek | F02P 9/002 |
| 2018/0066624 | A1* | 3/2018 | Kinoshita | F02P 3/005 |
| 2018/0187620 | A1* | 7/2018 | Raindl | H01T 13/58 |

FOREIGN PATENT DOCUMENTS

| | | |
|---|---|---|
| JP | 2009-180156 | 8/2009 |
| JP | 2010-065549 | 3/2010 |

(Continued)

*Primary Examiner* — Son T Le
*Assistant Examiner* — Adam S Clarke
(74) *Attorney, Agent, or Firm* — Nixon & Vanderhye P.C.

(57) ABSTRACT

In an ignition control device for controlling operation of an ignition apparatus, an ignition section has first and second electrodes disposed in a combustion chamber of an internal combustion engine. A voltage application between the first and second electrodes enables a discharge to be generated between the first and second electrodes for igniting a gas mixture in the combustion chamber. A voltage application section performs at least one application of a determination voltage between the first and second electrodes. An occurrence ratio acquisition section acquires a discharge occurrence ratio at the ignition section for the at least one application of the determination voltage. A comparison section compares the discharge occurrence ratio acquired by the occurrence ratio acquisition section with a predetermined determination threshold to thereby determine a degree of wear of at least one of the first and second electrodes.

12 Claims, 12 Drawing Sheets

(56) References Cited

FOREIGN PATENT DOCUMENTS

| | | |
|---|---|---|
| JP | 2015-218706 | 12/2015 |
| JP | 2016-053314 | 4/2016 |
| JP | 2016-176411 | 10/2016 |
| JP | 2017-145753 | 8/2017 |
| JP | 2019-152126 | 9/2019 |

* cited by examiner

IGNITION CONTROL DEVICE

CROSS REFERENCE TO RELATED APPLICATIONS

This application is based on and claims the benefit of priority from Japanese Patent Application 2018-36868 filed on Mar. 1, 2018, the disclosure of which is incorporated in its entirety herein by reference.

TECHNICAL FIELD

The present disclosure relates to ignition control devices.

BACKGROUND

Conventionally, a control device is provided for controlling the ignition of a gas-fuel mixture in a combustion chamber of an internal combustion engine. Specifically, the combustion chamber includes therein a spark plug comprised of electrodes. The control device generates a discharge between the electrodes to ignite the gas mixture.

SUMMARY

According to an exemplary aspect of the present disclosure, there is provided an ignition control device for controlling operation of an ignition apparatus. The ignition control apparatus includes an ignition section that has first and second electrodes disposed in a combustion chamber of an internal combustion engine. A voltage application between the first and second electrodes enables a discharge to be generated between the first and second electrodes for igniting a gas mixture in the combustion chamber. The ignition control apparatus includes a voltage application section that performs at least one application of a determination voltage between the first and second electrodes to generate a discharge between the first and second electrodes, thus igniting a gas mixture in the combustion chamber. The ignition control apparatus includes an occurrence ratio acquisition section that acquires a discharge occurrence ratio at the ignition section for the at least one application of the determination voltage, and a comparison section that compares the discharge occurrence ratio acquired by the occurrence ratio acquisition section with a predetermined determination threshold to thereby determine a degree of wear of at least one of the first and second electrodes.

DESCRIPTION OF THE EMBODIMENTS

Inventor's Viewpoint

A common ignition control device controls ignition of a gas-fuel mixture in a combustion chamber of an internal combustion engine; the combustion chamber includes therein a spark plug comprised of electrodes. The ignition control device generates a discharge between the electrodes to ignite the gas mixture.

In particular, the ignition control device obtains, as a discharge time, the length of time during which the flow of a discharge current based on the generated discharge continues. Then, the control device estimates, based on the discharge time, the degree of wear of the spark plug. For example, the ignition control device shortens the discharge time as the wear of the spark plug progresses.

The capability of continuous discharge between the electrodes of the spark plug in the combustion chamber may be sensitive to environment parameters in the combustion chamber, such as the internal temperature of the combustion chamber and the airflow in the combustion chamber.

For example, the discharge time may be relatively long depending on the environment parameters in the combustion chamber even though the wear of the electrodes of the spark plug has progressed to some extent. For this reason, the above ignition control device, which obtains, based on the discharge time, the wear of the electrodes of the spark plug as the wear of the spark plug, may result in lower accuracy of the obtained wear of the electrodes.

The present disclosure seeks to provide ignition control devices, each of which is capable of acquiring the degree of wear of electrodes with higher accuracy.

Embodiments

Embodiments of the present disclosure will now be described with reference to the drawings. Corresponding components in these embodiments may be assigned with like reference signs, so that duplicate descriptions of the corresponding components may be omitted. In each of the embodiments, the structure of at least one component, which is not particularly described, can be substantially equivalent to that of at least one component described in at least one of the other embodiments.

The structure and functions of one component in one of the embodiments can be combined with those of at least one component in one of the other embodiments as long as the combinations are within the subject matter of the present disclosure. That is, the present disclosure incorporates the combinations.

First Embodiment

Figure 1:
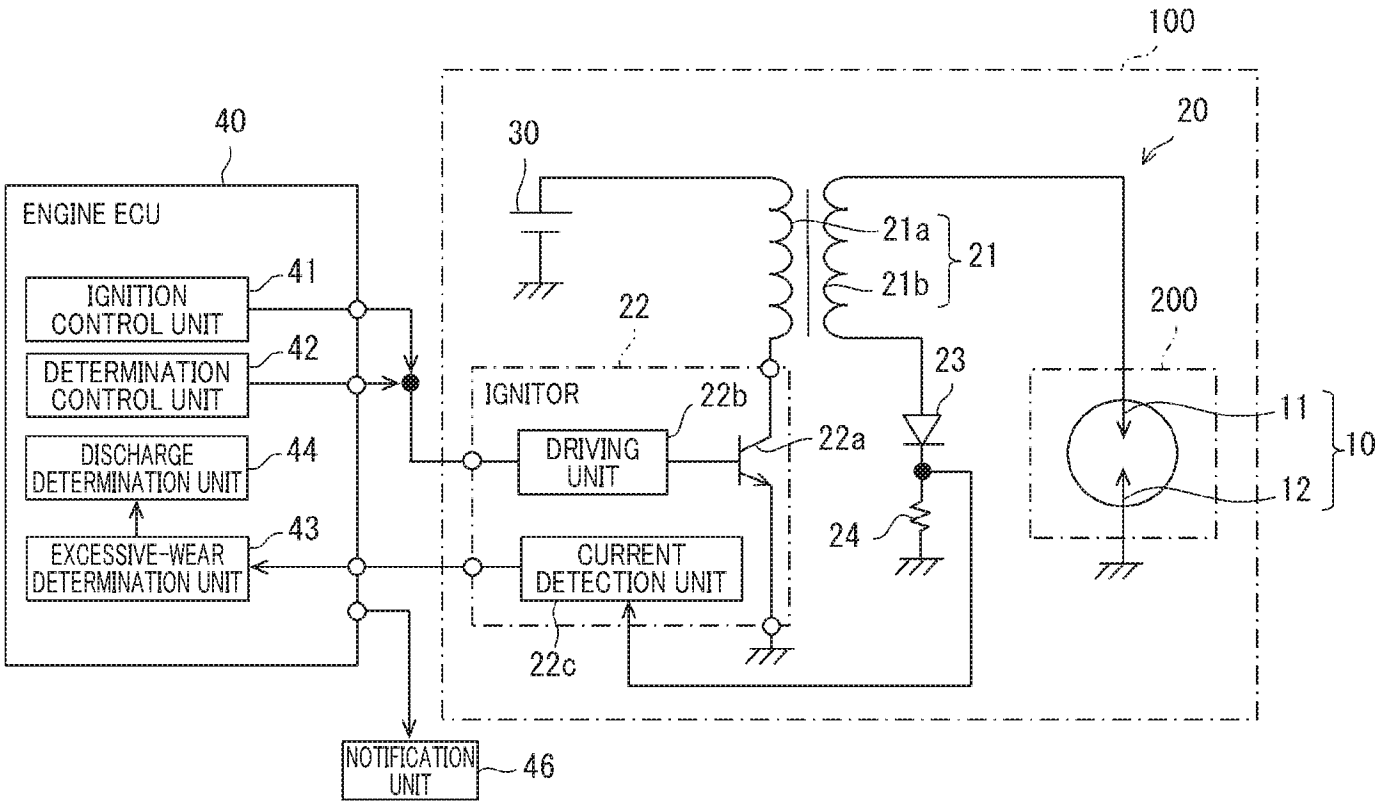
FIG. 1 is a circuit block diagram schematically illustrating an example of the configuration of an ignition apparatus according to the first embodiment of the present disclosure.

An ignition system S includes an ignition apparatus 100 and an engine ECU 40 for controlling the ignition apparatus 100 illustrated in FIG. 1. The ignition apparatus 100 shown in FIG. 1 includes an ignition plug 10, ignition circuit 20, igniter 22, and battery 30. The spark plug 10 is provided in a combustion chamber 200 of an engine such as a gasoline engine, which is for example installed in a vehicle. For example, the ignition circuit 20 causes the igniter 22 to generate a discharge in the spark plug 10, resulting in a gas mixture, such as an air-fuel mixture, in the combustion chamber 200 igniting. In the present embodiment, a combustion system is configured to include the engine and the ignition apparatus 100, and the engine corresponds to, for example, an internal combustion engine.

<Engine Behavior>

Before describing the ignition apparatus 100, the behavior of the engine will be described below. This engine is a four-stroke engine as an example. The engine is configured to repeat the cycle of the following intake stroke, compression stroke, expansion stroke, and exhaust stroke.

The following focuses on the four strokes in a cylinder of the engine.

In the intake stroke, the piston provided in the cylinder of the engine descends in the cylinder in conjunction with rotation of a crankshaft of the engine. This increases the volume of the combustion chamber 200 defined by the cylinder and piston. During an increase in the volume of the combustion chamber 200, opening an intake valve, which previously closed an intake port, enables the combustion chamber 200 and the intake port to communicate with each other. This enables gas, such as intake air, to be sucked into the combustion chamber 200 from the intake port. Additionally, an injector of the engine is controlled to inject atomized fuel into the intake port, resulting in the mixture of the fuel and the air, which will be referred to as an air-fuel mixture, flowing into the combustion chamber 200.

In the compression stroke, the piston passes through the bottom dead center and rises in the cylinder. This reduces the volume of the combustion chamber 200. During a decrease in the volume of the combustion chamber 200, closing the intake valve enables communication between the combustion chamber 200 and the intake port to be blocked by the intake valve while communication between the combustion chamber 200 and an exhaust port is blocked by an exhaust valve. This results in the air-fuel mixture in the combustion chamber 200 being compressed.

In the compression stroke, the ignition circuit 20 causes the igniter 22 to generate a discharge in the spark plug 10 when the piston is located at, before, or after the top dead center. The generated discharge ignites the air-fuel mixture to thereby burn the air-fuel mixture in the combustion chamber 200. This results in the air-fuel mixture expanding in the combustion chamber 200 in the expansion stroke, thereby pushing down the piston. The kinetic energy based on movement of the piston is converted into rotational energy of the crankshaft. The rotational energy of the crankshaft is outputted as an output of the engine to, for example, drive wheels of the vehicle via a power transmission device of the vehicle.

In the exhaust stroke, the exhaust valve is driven to open the exhaust port, which allows the combustion chamber 200 and exhaust port to communicate with each other when the piston starts to rise past the bottom dead center. This enables the exhaust gas in the combustion chamber 200 to be discharged via the exhaust port.

When the piston starts to descend past the bottom dead center after the exhaust stroke, the abovementioned intake stroke is performed again. As described above, the engine is configured to repeatedly perform the cycle of the sequential four strokes, that is, the intake stroke, compression stroke, expansion stroke, and exhaust stroke.

<Configuration of Ignition Apparatus>

The ignition apparatus 100 will now be described. In the ignition apparatus 100, the spark plug 10 includes a center electrode 11 and a ground electrode 12. As described above, the ignition apparatus 100 generates a discharge between the center and ground electrodes 11 and 12 to thereby ignite the air-fuel mixture in the combustion chamber 200. As shown in FIG. 1, the center electrode 11 is connected to the ignition circuit 20. The ground electrode 12 is connected to a predetermined first ground. The spark plug 10 corresponds to, for example, an ignition section.

Figure 2:
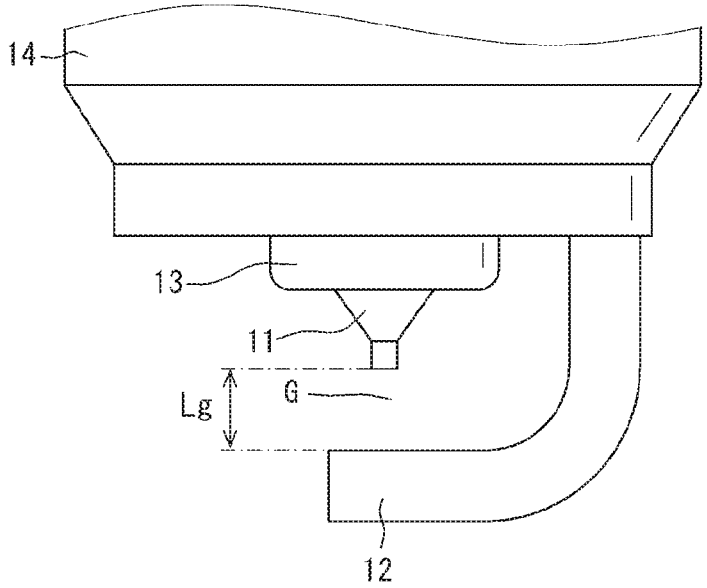
FIG. 2 is a structural view schematically illustrating a major part of a spark plug around a gap thereof illustrated in FIG. 1.

As shown in FIG. 2, the center electrode 11 and the ground electrode 12 are arranged to face each other in the combustion chamber 200.

Specifically, the spark plug 10 includes an elongated housing 14 with opposing first and second ends. For example, the elongated housing 14 is designed as an elongated hollow cylindrical shape. In the elongated housing 14, the center electrode 11, which has opposing first and second ends in its axial direction, is coaxially disposed with the first end of the center electrode 11 projecting from the first end of the housing 14. The spark plug 10 includes a cylindrical insulator 13 coaxially disposed in the housing 14 and supporting around the outer periphery of the center electrode 11.

The ground electrode 12 projects from a portion of the outer edge of the first end of the housing 14 to be separated therefrom, and is curved such that a tip end of the ground electrode 12 is located to face the first end of the center electrode 11.

The first end of the center electrode 11 protrudes toward the ground electrode 12 to be tapered theretoward. The first end of the center electrode 11 has a flat end surface, and the tip end of the ground electrode 12 has a flat end surface facing the flat end surface of the first end of the center electrode 11. The clearance between the flat end surface of the first end of the center electrode 11 and the flat end surface of the tip end of the ground electrode 12 is hereinafter referred to as a gap G. In the present embodiment, the size of the gap G is indicated by a gap length Lg, which is the shortest separation distance between the flat end surface of the first end of the center electrode 11 and the flat end surface of the tip end of the ground electrode 12. A plurality of grooves may be formed on the flat end surface of the tip end of the ground electrode 12 for promoting the generation of electric discharge. Alternatively, a plurality of protrusions protruding toward the flat end surface of the first end of the center electrode 11 may be mounted on the flat end surface of the tip end of the ground electrode 12.

As shown in FIG. 1, the ignition circuit 20 includes an ignition coil 21, an igniter 22, a diode 23, and a secondary current detection resistor 24. The battery 30 is a power supply unit for supplying electric power, i.e. a power supply voltage, to the ignition circuit 20, and the ignition circuit 20 receives the electric power supplied from the battery 30. The ignition circuit 20 controls the igniter 22 to thereby apply a controlled voltage, which is based on the power supply voltage supplied from the battery 30, between the center and ground electrodes 11 and 12. That is, the ignition circuit 20 corresponds to, for example, a voltage application section.

The ignition coil 21 has a primary coil 21*a* to which the power supply voltage is supplied from a battery 30, and a secondary coil 21*b* which supplies electric power to the spark plug 10. The primary coil 21*a* has opposing first and second ends, the first end of which is connected to a positive terminal of the battery 30, and the second end of which is connected to the igniter 22. The secondary coil 21*b* has opposing first and second ends, the first end of which is connected to the center electrode 22 of the spark plug 10, and the second end of which is connected to the anode of the diode 23. The primary and secondary coils 21*a* and 21*b* are magnetically coupled to each other while being electrically isolated from each other.

The engine ECU 40, which serves to include, for example, an ignition control device, that is electrically connected to the igniter 22 of the ignition apparatus 100, and that controls the operations of the igniter 22 to control the operations of the ignition apparatus 100. The engine ECU 40 includes, for example, a computer configured to be comprised of, for example, a processor, a storage unit, and an input/output interface. The storage unit includes at least a ROM, a RAM, and a semiconductor memory. The engine ECU 40 is electrically connected to various sensors and other ECUs, which are mounted on the vehicle. These sensors can be referred to as in-vehicle sensors, and these ECUs can be referred to as in-vehicle ECUs.

The engine ECU 40 receives various sensor signals measured by the respective in-vehicle sensors. The engine ECU 40 is capable of transmitting information items to the in-vehicle ECUs through an in-vehicle network provided in the vehicle, and receiving information items transmitted from the in-vehicle ECUs through the in-vehicle network. The engine ECU 40 generates, based on the various sensor signals sent from the in-vehicle sensors and the information items sent from the in-vehicle ECUs, a control signal for controlling the igniter 22, and outputs the control signal to the igniter 22.

The igniter 22 includes a switch section 22*a* for controlling energization or de-energization of the primary coil 21*a*, a driving unit 22*b* for driving the switching section 22*a*, and a current detection unit 22*c* for detecting a current flowing through the secondary coil 21*b*. The switching section 22*a* is comprised of a semiconductor switching element. For example, the switching section 22*a* of the first embodiment is comprised of a power bipolar transistor. Another semiconductor switching element, such as a MOSFET or an IGBT, can be used as the semiconductor switching element of the switching section 22*a*.

Both the driving unit 22*b* and the current detection unit 22*c* are electrically connected to the engine ECU 40. The driving unit 22*b* outputs, to the switching section 22*a*, a drive signal in accordance with a command signal outputted from the engine ECU 40. The current detection unit 22*c* outputs, to the engine ECU 40, a detection signal indicative of a current flowing through the secondary coil 21*b*.

The second end of the primary coil 21*a* is connected to the collector of the switching section 22*a*, and the emitter of the switching section 22*a* is connected to a second common signal ground to which a negative terminal of the battery 30 is connected. The base of the switching section 22*a* is connected to the driving unit 22*b*. The ECU 40 outputs an ON-command pulse to the base of the switching section 22*a* via the driving unit 22*b* to thereby turn on the switching section 22*a*, and stops the sending of the ON-command pulse to the base of the switching section 22*a* to thereby turn off the switching section 22*a*. The turn-on state, i.e. closed state, of the switching section 22*a* causes the primary coil 21*a* to be energized based on the power supply voltage of the battery 30, and the turn-off state, i.e. opened state, of the switching section 22*a* causes the primary coil 21*a* to be de-energized. The potential of the second common signal ground corresponds to, for example, a reference potential.

As described above, the second end of the secondary coil 21*b* is connected to the anode of the diode 23, and the cathode of the diode 23 is connected to a first end of the secondary current detection resistor 24, which will be referred to simply as a resistor 24 hereinafter. A second end of the resistor 24 is connected to a predetermined second ground. That is, the secondary coil 21*b* is connected to the second ground via the diode 23 and the resistor 24. The current detection unit 22*c* is connected to the connection point between the cathode of the diode 23 and the first end of the resistor 24. The current detection unit 22*c* detects a current flowing through the secondary coil 21*b*, and sends the detected current to the engine ECU 40.

The ignition circuit 20 of the first embodiment serves as an induction discharge circuit that causes inductive discharges to be generated in the spark plug 10 for igniting the air-fuel mixture.

Specifically, the engine ECU 40 causes the driver 22*b* to close the switching section 22*a* in a charge mode, so that the power supply voltage from the battery 30 is applied to the primary coil 21*a*. This causes a primary current I1 to flow through the primary coil 21*a*, so that the primary coil 21*a* is charged as electromagnetic energy based on the primary current I1. This causes a secondary voltage V2 with a first direction, i.e. a positive direction, from the center electrode 11 to the ground electrode 12 to be mutually induced across the secondary coil 21*b*. The diode 23 prevents a current based on the secondary voltage V2 from flowing from the center electrode 11 to the ground electrode 12. This prevents the occurrence of discharges between the center and ground electrodes 11 and 12.

Thereafter, the engine ECU 40 causes the driver 22*b* to open the switching section 22*a* in a discharge mode, so that the power supply voltage from the battery 30 is shut off, that is, the primary current I1 is shut off. This causes a primary voltage V1 based on the electromagnetic energy charged in the primary coil 21*a* to be self-induced across the primary coil 21*a*. The self-induced primary voltage V1 causes the secondary voltage V2, which has a second direction opposite to the first direction, to be mutually induced across the secondary coil 21*b*. Note that the second direction of the secondary voltage V2 is defined as a negative direction, so that the secondary voltage V2 generated in the discharge mode is a negative voltage. This causes the secondary voltage V2 to be applied between the center electrode 11 and the ground electrode 12, thus generating a discharge between the center electrode 11 and the ground electrode 12. The occurrence of the discharge causes a current, i.e. a secondary current I2, to flow from the diode 23, resistor 24, the ground electrode 12, and the center electrode 11 in this order.

The rectifying function of the diode 23 enables the secondary current I2 based on the negative secondary voltage V2 in the discharge mode to flow to the common ground via the diode 23 and the resistor 24. This enables the resistor 24 to measure a positive value of the secondary current I2 based on the negative secondary voltage V2.

The engine ECU 40 alternately performs the discharge mode and the charge mode, thus repeatedly applying the secondary voltage V2 between the center electrode 11 and the ground electrode 12. This enables the resistor 24 to measure the frequency of occurrence of discharges based on the secondary current I2 flowing through the resistor 24.

When a discharge generated between the electrodes 11 and 12 shifts to an arc discharge due to the electromagnetic energy stored in the ignition coil 21 being sufficiently large, the secondary voltage V2 and the secondary current I2 are continuously generated for a certain period of time. This enables the air-fuel mixture in the combustion chamber 200 to be ignited by the arc discharge generated between the center electrode 11 and the ground electrode 12.

In the spark plug 10, when the gap G is enlarged due to the increased wear of the electrodes 11 and 12, a discharge between the electrodes 11 and 12 is less likely to occur.

An increase in wear of the electrodes 11 and 12 may cause the gap G to be enlarged. This may increase a possibility of spark discharge failure between the electrodes 11 and 12.

Repeatedly generating discharges between the electrodes 11 and 12 causes the wear of the electrodes 11 and 12 to progress, resulting in the gap G increasing.

Here, an increase in the gap length Lg of the gap G is referred to as enlargement of the gap G. The enlargement of the gap G increases a possibility of spark discharge failure between the electrodes 11 and 12.

The amount of increase in the gap length Lg is also be referred to as the amount of wear of at least one of the electrodes 11 and 12.

The engine ECU 40 functionally includes an ignition control unit 41 that controls the operation of the ignition circuit 20 to ignite the air-fuel mixture, and a determination control unit 42 that controls the operation of the ignition circuit 20 to determine whether the wear of at least one of the electrodes 11 and 12 has progressed to a predetermined wear threshold. That is, when the wear of at least one of the electrodes 11 and 12 has progressed to the wear threshold, the electrodes 11 and 12, the electrodes 11 and 12 have been excessively worn.

The engine ECU 40 is capable of outputting, to the igniter 22, application signals IGt, each of which causes the ignition circuit 20 to apply the second voltage V2 between the electrodes 11 and 12. The application signals IGt include an ignition signal IGta for generating the secondary voltage V2 having several tens of kV for igniting the air-fuel mixture, and a determination signal IGtb for generating the secondary voltage V2 having several kV for determining the degree of ware of at least one of the electrodes 11 and 12.

Note that each of the ignition signal IGta and determination signal IGtb includes at least one ON-command pulse for turning on the switching section 22*a* during the on duration of the at least one ON-command pulse, and for turning off the switching section 22*a* after lapse of the on duration of the at least one ON-command pulse.

The engine ECU 40 also functionally includes a discharge determination unit 43 that determines whether a discharge has occurred when the secondary voltage V2 based on the determination signal IGtb applied between the electrodes 11 and 12, and a wear threshold determination unit 44 that determines whether the wear of at least one of the electrodes 11 and 12 has progressed to the wear threshold.

The engine ECU 40 is connected to a notification unit 46 installed in the vehicle. The engine ECU 40 causes the notification unit 46 to notify a user, such as a vehicle's driver, of various types of information. For example, the notification unit 46 includes a display unit for displaying various types of visible information on, for example, a display panel, and/or a sound output unit for outputting various types of audible information from, for example, a speaker.

For example, the ignition control unit 41 of the engine ECU 40 outputs the ignition signal IGta to the driving unit 22*b* to thereby apply the secondary voltage V2 between the electrodes 11 and 12. This causes the ignition circuit 20 to perform a main ignition operation. A value V2*a* of the secondary voltage V2 applied between the electrodes 11 and 12 based on the ignition signal IGta for generating a discharge between the electrodes 11 and 12 is set to be sufficiently higher than a value V2*b* of the secondary voltage V2 applied between the electrodes 11 and 12 based on the determination signal IGtb.

Figure 3:
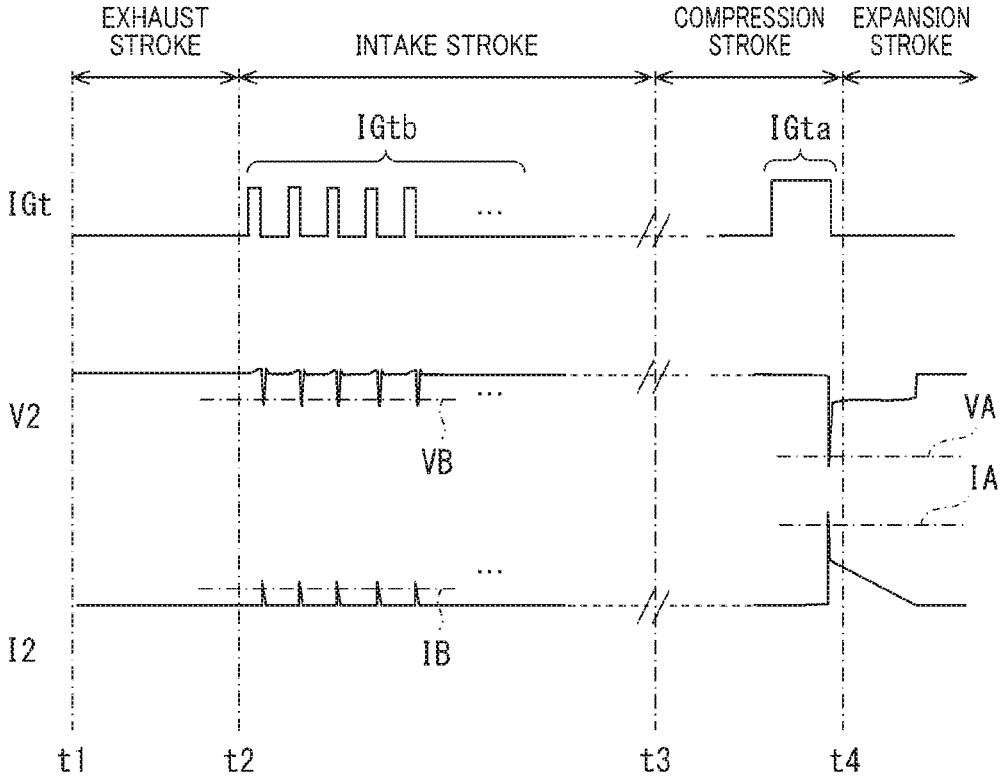
FIG. 3 is a timing chart schematically illustrating how a secondary current flows when the spark plug is in a normal state.

For example, the engine ECU 40, i.e. the ignition control unit 41, outputs the ignition signal IGta in response to each ignition timing. As shown in FIG. 3, if the exhaust stroke starts at the timing t1, the intake stroke starts at the timing t2, the compression stroke starts at the timing t3, and the expansion stroke starts at the timing t4 in each combustion cycle, the engine ECU 40 outputs the ignition signal IGta in response to the timing t4 of each combustion cycle as the ignition timing. This causes the secondary voltage V2 to be applied between the electrodes 11 and 12 in response to each ignition timing, thereby generating a discharge therebetween. This results in the secondary current I2 flowing through the discharge generated between the electrodes 11 and 12

For example, the determination control unit 42 of the engine ECU 40 outputs the determination signal IGtb to the driving unit 22*b* to thereby cause the ignition circuit 20 to apply the secondary voltage V2 between the electrodes 11 and 12 one or more times in each combustion cycle. The value V2*b* of the secondary voltage V2 applied between the electrodes 11 and 12 based on the determination signal IGtb is set to be lower than the value V2*a* of the secondary voltage V2 applied between the electrodes 11 and 12 based on the ignition signal IGta. The value V2*b* of the secondary voltage V2 applied between the electrodes 11 and 12 based on the determination signal IGtb is determined to enable a discharge to occur more easily if the spark plug 10 is a new spark plug and to be less likely to occur if the spark plug 10 is a worn plug. In other words, the value V2*a* of the secondary voltage V2 applied between the electrodes 11 and 12 based on the determination signal IGtb is determined such that, the more the spark plug 10 is frequently used, the more difficulty with which a discharge will occur between the electrodes 11 and 12.

A discharge occurring when the value V2*b* of the secondary voltage V2 is applied between the electrodes 11 and 12 based on the determination signal IGtb causes the secondary current I2 to flow through the generated discharge. The discharge determination unit 43 is configured to determine that a discharge has occurred when a value of the secondary current I2 becomes higher than a predetermined current threshold IB. The discharge determination unit 43 is also configured to determine that a discharge has not occurred between the electrodes 11 and 12 when the value of the secondary current I2 is lower than the current threshold IB.

For example, the engine ECU 40 is configured to set an application period of the value V2*b* of the secondary voltage V2 based on the determination signal IGtb to be shorter than an application period of the value V2*a* of the secondary voltage V2 based on the ignition signal IGta. This configuration therefore enables a time for which the primary coil 21*a* has been charged based on the determination signal IGtb to be shorter than a time for which the primary coil 21*a* has been charged based on the ignition signal IGta, result in the electromagnetic energy stored in the primary coil 21*a* based on the determination signal IGtb being smaller than the electromagnetic energy stored in the primary coil 21*a* based on the ignition signal IGta. This results in the electromagnetic energy stored in the primary coil 21*a* by voltage application based on the determination signal IGtb being smaller than the electromagnetic energy stored in the primary coil 21*a* by voltage application based on the ignition signal IGta.

Therefore, even if a discharge occurs between the electrodes 11 and 12 based on the determination signal IGtb, this configuration enables the generated discharge to quickly disappear due to the smaller electromagnetic energy stored in the primary coil 21*a*.

In the present embodiment, the value V2*b* of the secondary voltage V2 applied based on the determination signal IGtb is set to as small a value as possible such that (1) The longer the gap length Lg of the spark plug 10 relative to a reference length is, the more difficult it is for a discharge to occur between the electors 11 and 12

(2) Little influence is found on the combustion of the air-fuel mixture

The reference length of the spark plug 10 is, for example, an initial gap length of the spark plug 10 that has not been used yet.

Specifically, when the value V2*b* of the secondary voltage V2 is applied between the electrodes 11 and 12 one or more times based on one or more times of the pulses of the determination signal IGtb being sent to the igniter 22, the number of times the secondary current I2 does not reach the current threshold IB increases as the wear of at least one of the electrodes 11 and 12 progresses.

For example, FIG. 3 illustrates that values of the secondary current I2 are obtained respectively for several times of secondary-voltage applications based on the determination signal IGtb between unused electrodes 11 and 12 of the spark plug 10. FIG. 3 shows that all the values of the secondary current I2 become higher than the current threshold IB. This results in the discharge occurrence ratio for the spark plug 10 that has the unused electrodes 11 and 12 being 100%.

Figure 4:
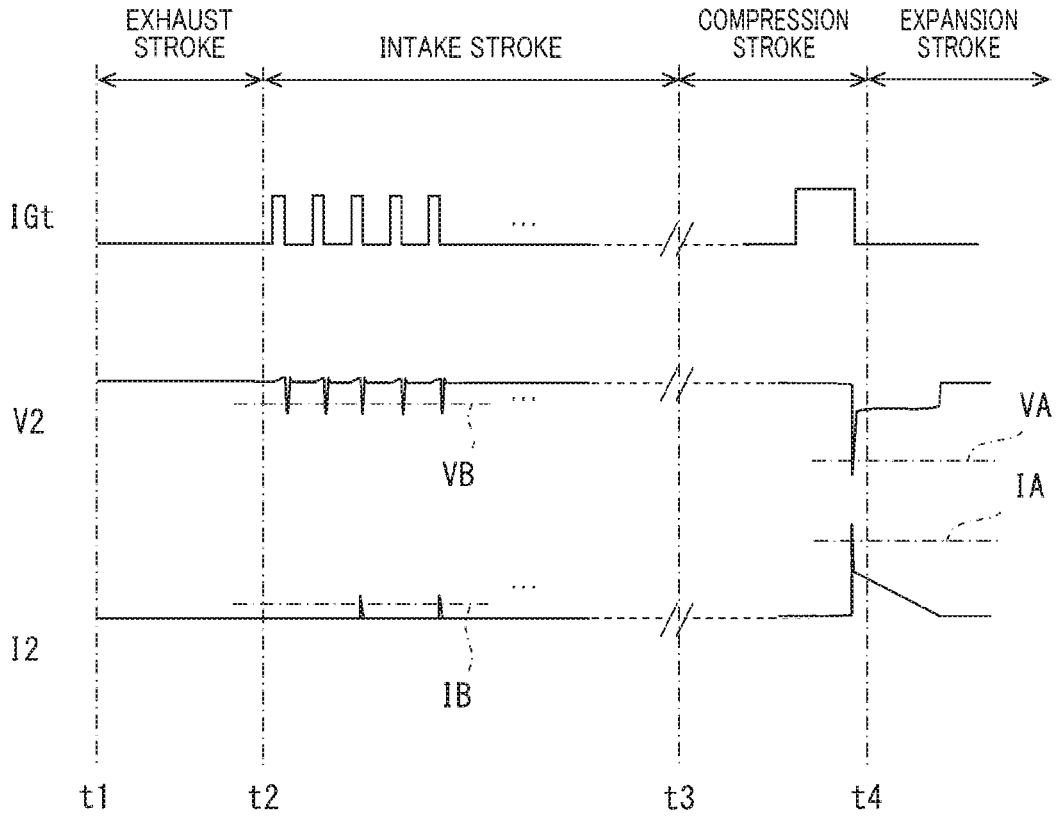
FIG. 4 is a timing chart schematically illustrating how the secondary current flows when the spark plug is excessively worn.

In contrast, FIG. 4 illustrates that values of the secondary current I2 are obtained respectively for several times of secondary-voltage applications based on the determination signal IGtb between excessively worn electrodes 11 and 12 of the spark plug 10. FIG. 4 shows that some values of the secondary current I2 do not exceed the current threshold IB. Specifically, as illustrated in FIG. 4, two values of the secondary current I2 obtained for five times of secondary-voltage applications based on the determination signal IGtb between the excessively worn electrodes 11 and 12 do not exceed the current threshold IB. This results in the discharge occurrence ratio for the excessively worn electrodes 11 and 12 of the spark plug 10 being 40%.

As described above, the discharge occurrence ratio for the electrodes 11 and 12 of the spark plug 10, which is obtained based on the ratio of the number of times a discharge occurs, i.e. when the generated secondary current I2 becomes higher than the current threshold IB, to the number of times the value V2*b* of the secondary voltage V2 is applied based on the determination signal IGtb, serves as a parameter for determining whether the wear of at least one of the electrodes 11 and 12 has progressed to the predetermined wear threshold. In other words, the discharge occurrence ratio for the electrodes 11 and 12 of the spark plug 10 serves as a parameter for determining whether the gap length Lg has increased up to a threshold gap value corresponding to the predetermined wear threshold.

For this reason, the above test in measuring a value of the secondary current I2 for each secondary-voltage application based on the determination signal IGtb were repeated to thereby obtain the number of times the value V2*b* of the secondary voltage V2 is applied based on the determination signal IGtb, the value V2*b* of the secondary voltage V2 for each application, and the other voltage application conditions, which are required to suitably determine whether the wear of at least one of the electrodes 11 and 12 has progressed to the predetermined wear threshold.

Then, a threshold for the discharge occurrence ratio for suitably determine whether the wear of at least one of the electrodes 11 and 12 has progressed to the predetermined wear threshold was determined beforehand in accordance with the obtained number of times the value V2*b* of the secondary voltage V2 is applied based on the determination signal IGtb, the obtained value V2*b* of the secondary voltage V2 for each application, and the obtained other voltage application conditions. The discharge occurrence ratio is hereinafter also referred to as a discharge ratio, and the threshold for the discharge occurrence ratio is hereinafter referred to as a threshold discharge ratio.

That is, the discharge ratio represents the ratio of the number of times a discharge occurs, i.e. the generated secondary current I2 becomes higher than the current threshold IB, to the number of times the value V2*b* of the secondary voltage V2 is applied based on the determination signal IGtb.

In the combustion chamber 200, it is considered that as the number of free electrons contained in the air-fuel mixture increases, discharge is more likely to occur with the application of a voltage between the electrodes 11 and 12. When a voltage is applied between the electrodes 11 and 12, in the combustion chamber 200, a part of the air-fuel mixture located to be closer to the center electrode 11 is ionized to generate plasma, creating a plasma atmosphere in the combustion chamber 200. In this case, even if a discharge does not occur between the electrodes 11 and 12 with one application of the second voltage V2 between the electrodes 11 and 12, plasma is generated, so that the number of free electrons in the plasma in the combustion chamber 200 increases as the number of voltage application increases, resulting in the environment in the combustion chamber 200 in which a discharge is likely to occur.

The gap length Lg between the electrodes 11 and 12 becomes greater with progress of wear of at least one of the electrodes 11 and 12, the number of free electrons required for generating a discharge, increases, resulting in an increase in the number of secondary-voltage applications, which is necessary for generating the number free electrons required for generating a discharge.

Therefore, as described above, when the secondary-voltage application between the electrodes 11 and 12 is performed a plurality of times, the number of times the secondary current I2 does not flow increases as the wear of at least one the electrodes 11 and 12 progresses.

The number of secondary-voltage applications for obtaining each of the previously measured values of the discharge ratio, which corresponds to one of the measured degrees of wear of at least one of the electrodes 11 and 12 (see, for example, FIG. 8) is set to be preferably identical to the number of secondary-voltage applications for checking the degree of wear of at least one of the electrodes 11 and 12.

In the combustion chamber 200, even if the flow rate of the air-fuel mixture increases or the temperature of the air-fuel mixture increases for a short period of time, the situation where free electrons are difficult to move is less likely to occur. For this reason, in a state in which the number of free electrons in the combustion chamber 200 sufficiently increases as a result of applying the secondary voltage V2 between the electrodes 11 and 12 a plurality of times for a short period of time, a discharge between the electrodes 11 and 12 is less likely to be affected by environmental factors in the combustion chamber 200, such as the temperature and the flow rate of the air-fuel mixture in the combustion chamber 200. A plurality of secondary-voltage applications enables generated discharges to be more insulated from the environmental factors than a discharge generated by a single secondary-voltage application, resulting in an increase of the accuracy of determining whether the wear of at least one of the electrodes 11 and 12 has progressed to a predetermined wear threshold.

Let us consider a method of measuring the duration of a discharge generated between the electrodes 11 and 12 as another approach for determining whether the wear of at least one of the electrodes 11 and 12 has progressed to a predetermined wear threshold. Unfortunately, this approach may result in a streamer discharge generated between the electrodes 11 and 12 more easily disappearing in the combustion chamber 200 as the flow rate of the air-fuel mixture becomes higher. For this reason, the duration of a discharge may vary with the flow rate of the air-fuel mixture in the combustion chamber 200. Additionally, the duration of a discharge may also vary with the temperature or pressure in the combustion chamber 200 in addition to the flow rate of the air-fuel mixture.

As shown in FIG. 3, the engine ECU 40 is configured to sequentially output the pulses of the determination signal IGtb upon the start of the intake stroke for each combustion cycle. Specifically, the engine ECU 40 starts to perform sequential secondary-voltage applications based on the respective pulses of the determination signal IGtb at the timing t2 at which the intake stroke starts, and terminates the sequential secondary-voltage applications before the timing t3 at which the intake stroke ends. The number of secondary-voltage applications based on the respective pulses of the determination signal IGtb for obtaining an actual discharge ratio is set to be identical to the number of times the value V2*b* of the secondary voltage V2 is applied based on the determination signal IGtb for the previously obtained threshold discharge ratio.

For example, the number of secondary-voltage voltage applications based on the respective pulses of the determination signal IGtb for obtaining an actual discharge ratio is set to 50 times that is identical to the number of times the value V2*b* of the secondary voltage V2 is applied based on the determination signal IGtb for the previously obtained threshold discharge ratio.

For a plurality of secondary-voltage applications performed based on the respective pulses of the determination signal IGtb, the interval from the start of a present secondary-voltage application to the start of the next secondary-voltage application can be appropriately set so that, even if a discharge occurs based on the present secondary-voltage application, the discharge ends before the start of the next secondary-voltage application.

Each of the application signals IGt is a pulse signal having a plurality of pulses whose voltage levels switch between a high level and a low level. For example, the ignition signal IGta is comprised of one pulse, i.e. the ON-command pulse, for each combustion cycle, and the determination signal IGtb is comprised of one or more pulses, i.e. the one or more ON-command pulses for each combustion cycle. That is, for each combustion cycle, the secondary-voltage application based on the ignition signal IGta is performed only once, while the secondary-voltage application with the determination signal IGtb is performed one or more times.

<Ignition Control Routine>

The engine ECU 40, which is hereinafter referred to as an ECU 40, periodically performs an ignition control routine for controlling the operation of the ignition apparatus 100. The ignition control routine will now be described with reference to the flowcharts of respective FIGS. 5 to 7. Note that the ECU 40 is programmed to execute the following steps illustrated in FIGS. 5 to 7.

Figure 5:
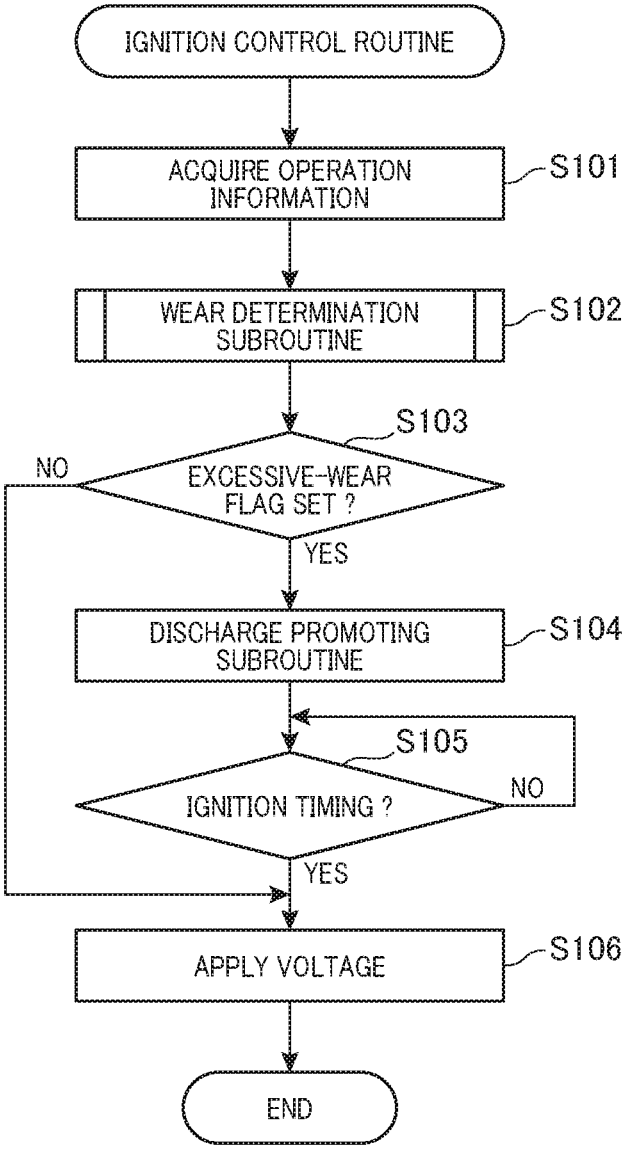
FIG. 5 is a flowchart schematically illustrating a procedure of an ignition control routine.

At step S101 of a present cycle of this routine in FIG. 5, the ECU 40 acquires operating condition information indicative of the operating condition of the engine. That is, the ECU 40 reads, from the in-vehicle sensors and/or the in-vehicle ECUs, the operating condition information including the engine rotational speed and the engine load information. At step S102, the ECU 40 performs a wear determination subroutine for determining whether the wear of at least one of the electrodes 11 and 12 has progressed to the wear threshold. This wear determination subroutine will be described with reference to the flowchart of FIG. 6.

Figure 6:
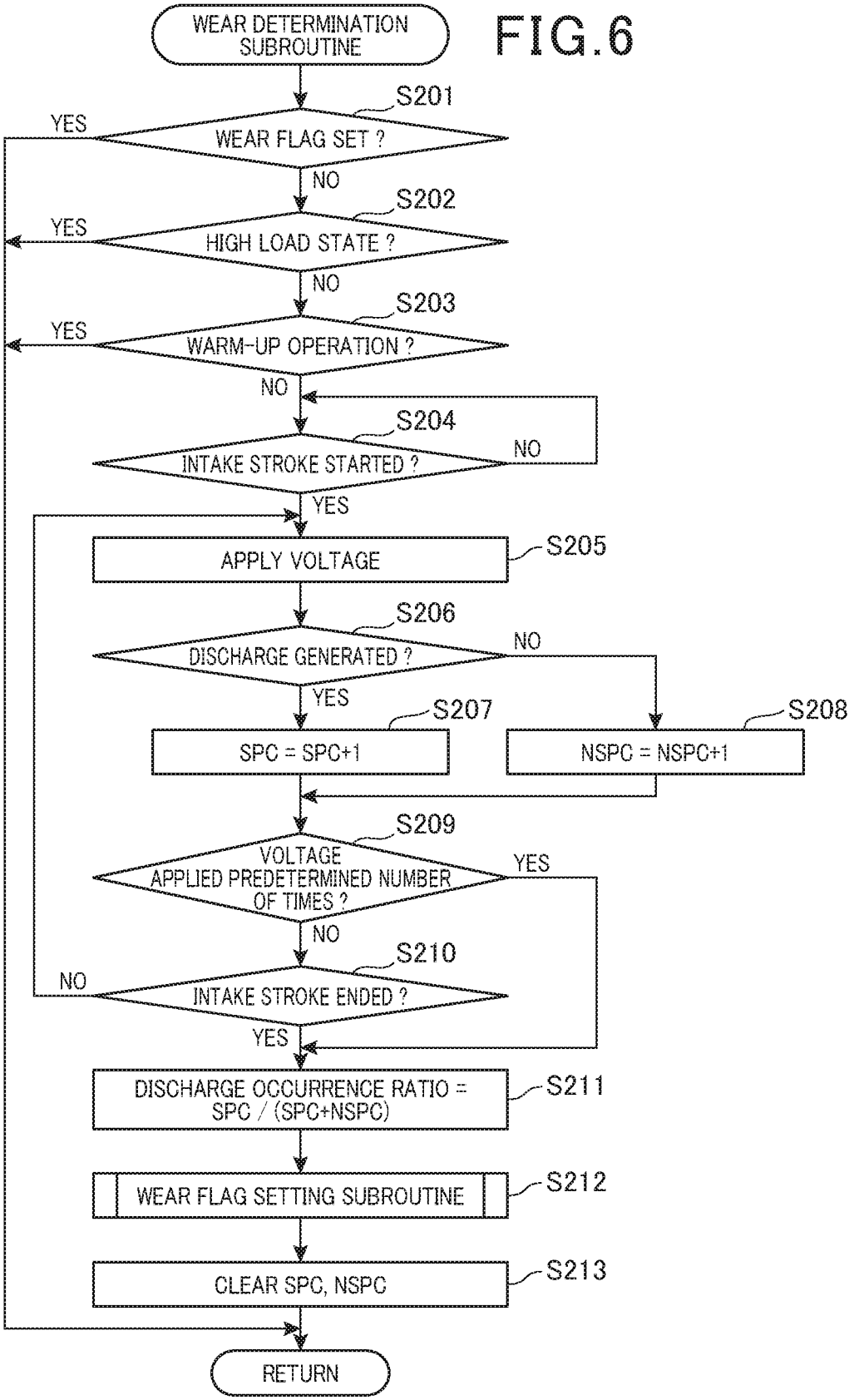
FIG. 6 is a flowchart schematically illustrating a procedure of a wear determination subroutine included in the ignition control routine.

At step S201 in FIG. 6, the ECU 40 determines whether a wear flag has been set in one of the previously performed cycles of the routine; this wear flag has been stored in, for example, the storage unit of the ECU 40 as a result of one of the previously performed cycles of the routine. Note that each flag described in the specification has an initial value of zero.

If the wear flag has not been set (NO at step S201), the ECU 40 determines whether the ECU 40 should perform wear determination for the electrodes 11 and 12 at steps S202 and S203 based on the operating condition of the engine. Otherwise, if the wear flag has been set (YES at step S201), the ECU 40 terminates the wear determination subroutine.

At step S202, the ECU 40 determines whether the operating condition of the engine is in a high load condition. The operating condition of the engine includes at least a low load condition and a medium load condition in addition to the high load condition, where the load is higher in the high load condition than in either the low load condition or the medium load condition. The engine operating condition is in the high load condition when, for example, the amount of intake air to the engine rapidly increases, such as when the vehicle is traveling on an uphill slope or during acceleration. In this case, it is determined that an actual discharge ratio is likely to change, so that the ECU 40 determines that the ECU 40 should not perform the wear determination (YES at step S202), terminating the routine.

Otherwise, when it is determined that the engine operating condition is not in the high load condition (NO at step S202), the routine proceeds to step S203.

At step S203, the ECU 40 determines whether the engine is performing a predetermined warm-up operation. Specifically, at step S203, the ECU 40 determines whether a coolant temperature of the engine is lower than a predetermined first temperature threshold, or whether an oil temperature of the engine is lower than a predetermined second temperature threshold. When determining that the coolant temperature is lower than the predetermined first temperature threshold or the engine oil temperature is lower than the predetermined second temperature threshold, the ECU 40 determines that the engine is performing the warm-up operation (YES at step S203). Then, the ECU 40 determines that the ECU 40 should not perform the wear determination, terminating this routine. Otherwise, when it is determined that the engine is not performing the warm-up operation (NO at step S203), the routine proceeds to step S204.

That is, when the operating condition of the engine is not the high load condition and the engine is also not performing the warm-up operation (NO at each of steps S202 and S203), the ECU 40 determines that the ECU 40 should perform the wear determination using the threshold discharge ratio obtained in advance. Then, the routine proceeds to steps S204 to S213.

At step S204, the ECU 40 determines whether the intake stroke, whose air flow condition satisfies the air flow condition associated with the predetermined threshold discharge ratio, has started. When the intake stroke, whose air flow condition satisfies the air flow condition associated with the predetermined threshold discharge ratio, has not started (NO at step S204), the ECU 40 repeatedly performs the determination at step S204. When it is determined that the intake stroke has started (YES at step S204), the routine proceeds to step S205.

At step S205, the ECU 40 outputs one pulse of the determination signal IGtb to the igniter 22, and applies the value V2*b* of the secondary voltage V2 between the electrodes 11 and 12 once, based on the pulse of the determination signal IGtb.

The number of secondary-voltage applications based on respective pulses of the determination signal IGtb between the electrodes 11 and 12, and the value V2*b* of the secondary voltage V2 for each secondary-voltage application are predetermined by, for example, the above described tests. The number of secondary-voltage applications based on respective pulses of the determination signal IGtb between the electrodes 11 and 12 has been converted into detection count data, and the value V2*b* of the secondary voltage V2 for each secondary-voltage application has been converted into an on-duration of each pulse of the determination signal IGtb, and they are stored in, for example, the storage unit. If the value V2*b* of the secondary voltage V2 generated based on the determination signal IGtb is set in advance, the threshold, i.e. the threshold discharge ratio, for determining whether the spark plug 10 is excessively worn is set for the gap length Lg of the spark plug 10.

Figure 8:
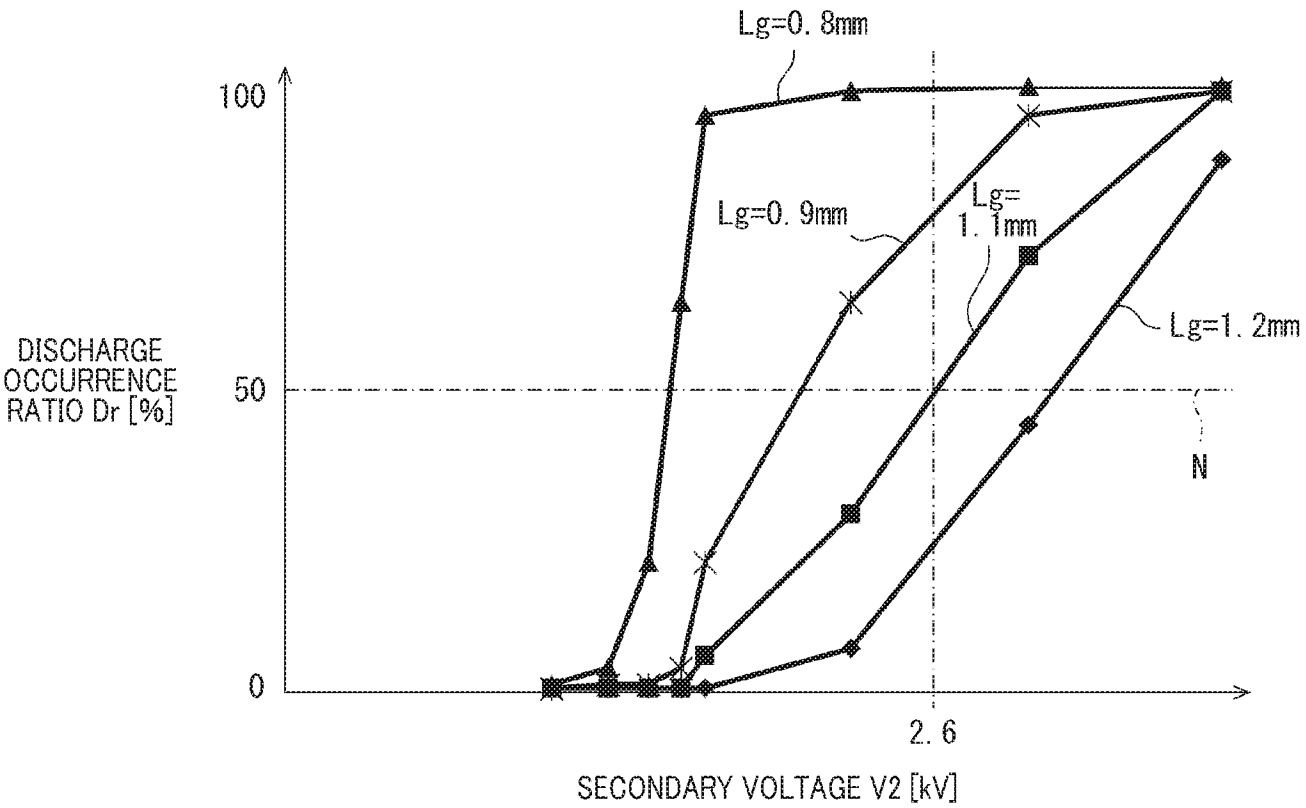
FIG. 8 is a graph schematically illustrating an example of the relationship among a secondary voltage, a discharge occurrence ratio, and a gap length.

FIG. 8 shows an example of the results of 50 tests that were conducted on each of plugs having different gap lengths Lg and attached to the engine with the application voltage changed in the intake stroke. When the secondary voltage V2 applied between the electrodes 11 and 12 is any value, the larger the gap length Lg, the lower the discharge occurrence ratio Dr; the discharge occurrence ratio Dr represents the probability that discharges have occurred between the electrodes 11 and 12 for 50 secondary-voltage applications performed based on the respective pulses of the determination signals IGtb.

When the discharge occurrence ratio Dr is any value, the larger the gap length Lg, the larger the secondary application voltage required for a discharge. Note that the number of secondary voltage applications, each application timing, and the value of each application voltage are appropriately set by the test for determining them in advance. The information representing the relationships among values of the discharge occurrence ratio Dr, values V2*b* of the secondary voltage V2 to be applied between the electrodes 11 and 12, and values of the gap length Lg is stored in the storage unit as gap-discharge relationship information.

For example, with an unused spark plug 10 having the gap length Lg of 0.8 mm, the unused spark plug 10 is assumed to be excessively worn when the gap length Lg increases to 1.1 mm. In this case, with the secondary voltage V2 set to 2.6 kV, the discharge occurrence ratio Dr is 50%, and this 50% is set to a ratio threshold N which is a threshold for determining whether the electrodes 11 and 12 are excessively worn based on the discharge occurrence ratio Dr. In this manner, the secondary voltage V2 applied between the electrodes 11 and 12 with the determination signal IGtb and the ratio threshold N are set in advance. In FIG. 8, it is more preferable to set the secondary voltage V2 to 2.4 kV and set the ratio threshold N to 15%, thus reducing the value of the secondary voltage V2 and increasing the sensitivity by increasing the difference in the discharge occurrence ratio. The ratio threshold N is also referred to as a discharge ratio threshold N set forth above.

Returning back to FIG. 6, at step S206, the ECU 40 determines, as a function of the secondary current I2 and the determination current value IB, whether a discharge has occurred between the electrodes 11 and 12 due to the application of the secondary voltage V2 based on the one pulse of the determination signal IGtb.

Specifically, at step S206, the ECU 40 acquires the secondary current I2 using the detection signal from the current detection unit 22*c*, and determines whether the secondary current I2 is larger than the determination current value IB. When determining that the secondary current I2 is larger than the determination current value IB, the ECU 40 determines that a discharge has occurred. Otherwise, when determining that the secondary current I2 is not larger than the determination current value IB, the ECU 40 determines that a discharge has not occurred. The determination current value IB corresponds to, for example, a threshold current.

If it is determined that a discharge has occurred, the routine advances to step S207. At step S207, the ECU 40 increments a discharge counter SPC, which has been prepared in the ECU 40, for counting the number of times a discharge has occurred due to the application of the secondary voltage V2 between the electrodes 11 and 12. Otherwise, if it is determined that no discharge has occurred, the routine proceeds to step S208. At step S208, the ECU 40 increments a no-discharge counter NSPC, which has been prepared in the ECU 40, for counting the number of times a discharge has not occurred despite the secondary voltage application between the electrodes 11 and 12 is incremented.

After incrementing the counter SPC or the counter NSPC, the ECU 40 performs a task of determining whether a voltage application count, which is calculated based on the sum of the value of the discharge counter SPC and the value of the non-discharge counter NSPC, has reached a predetermined threshold number of times at step S209. If it is determined that the voltage application count has not reached the predetermined number of times, the routine proceeds to step S210. Otherwise if the voltage application count has reached the predetermined threshold number of times, the routine proceeds to step S211.

At step S210, the ECU 40 determines whether the intake stroke has ended. If it is determined that the voltage application count has not reached the predetermined threshold number of times and the intake stroke has not ended, the ECU 40 repeatedly performs the operations at steps S205 to S208. In particular, if the voltage application count has not reached the predetermined number of times and the intake stroke has not ended, the ECU 40 waits for a predetermined duration, and thereafter, repeatedly performs the operations at steps S205 to S208. This duration is set to be longer than a time required for a discharge, which has been determined to occur in step S205, to disappear. This prevents a value of the secondary voltage V2 applied between the electrodes 11 and 12 for the present step S205 from increasing due to electromagnetic energy having remained in the primary winding 21*a* by the previous step S205. Thus, at step S206, it is possible to reliably determine whether a discharge has occurred for each of secondary voltage applications.

When it is determined that the intake stroke ends (YES at step S210), the ECU 40 calculates the discharge occurrence ratio Dr at step S211.

Specifically, at step S211, the ECU 40 divides the value of the discharge counter SPC by the sum of the value of the discharge counter SPC and the value of the NSPC, thus calculating the discharge occurrence ratio Dr. The expression for this calculation can be expressed by SPC/(SPC+NSPC). That is, the discharge occurrence ratio Dr is a ratio of the number of times a discharge occurs to the number of times the secondary voltages V2 are applied based on the respective pulses of the determination signal IGtb. This calculation of the discharge occurrence ratio Dr corresponds to, for example, the acquisition of information, which is hereinafter referred to as discharge occurrence situation information, indicative of how discharges have occurred in the spark plug 10 based on one or more secondary voltage applications between the electrodes 11 and 12.

At step S212, the ECU 40 performs a wear flag setting subroutine for determining whether to set the wear flag. The wear flag setting subroutine will be described with reference to the flowchart of FIG. 7.

Figure 7:
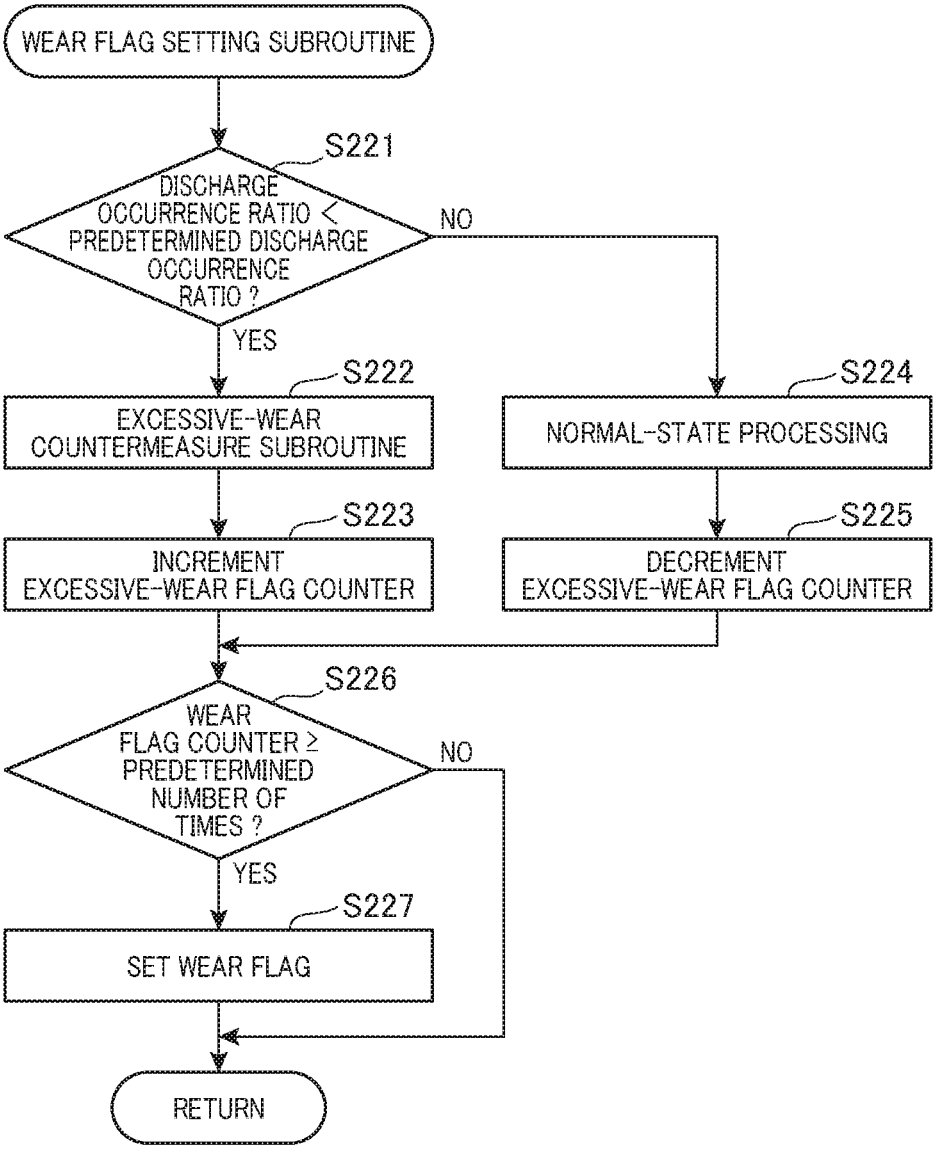
FIG. 7 is a flowchart schematically illustrating a procedure of a wear flag setting subroutine included in the ignition control routine.

In FIG. 7, the ECU 40 determines whether the discharge occurrence ratio Dr is smaller than the predetermined ratio threshold N at step S221. For example, the ratio threshold N is set to the discharge ratio of 50%, that is, 0.5, for the value V2*b* of 2.6 kV of the secondary voltage V2. The discharge occurrence ratio Dr corresponds to, for example, a result of acquiring the discharge occurrence situation information, the ratio threshold N corresponds to, for example, a predetermined determination threshold, and the determination of whether the discharge occurrence ratio Dr is smaller than the ratio threshold N corresponds to, for example, the comparison of the result of acquiring the discharge occurrence situation information with the ratio threshold N.

When determining that the discharge occurrence ratio Dr is smaller than the ratio threshold N (YES at step S221), the ECU 40 determines that the electrodes 11 and 12 are excessively worn. Then, the ECU 40 performs a wear countermeasure subroutine at step S222.

Specifically, the ECU 40 causes the notification unit 46 to issue a notification representing, for example, that the electrodes 11 and 12 are excessively worn and/or replacement of the spark plug 10 is recommended. Then, the ECU 40 increments or decrements a wear flag counter, which serves as a determination counter and has been provided therein, for determining whether to set the wear flag in accordance with the determination result of the discharge occurrence ratio Dr at step S221.

Specifically, if it is determined that the discharge occurrence ratio Dr is smaller than the ratio threshold N (YES at step S221), the ECU 40 increments the wear flag counter at step S223. Otherwise, if the discharge occurrence ratio Dr is not smaller than the ratio threshold N (NO at step S222), the ECU 40 performs a predetermined normal task at step S224, and decrements the wear flag counter at step S225.

For example, the ECU 40 performs, as the normal task, a task of recognizing that the electrodes 11 and 12 are in the normal state, and preventing execution of the wear countermeasure subroutine. When the electrodes 11 and 12 are in the normal state, the wear of the electrodes 11 and 12 has not progressed, or the wear of the electrodes 11 and 12 has progressed without reaching the wear threshold where the electrodes 11 and 12 are excessively worn. At step S224, the ECU 46 can cause the notification unit 46 to issue a notification representing, for example, that the electrodes 11 and 12 are in the normal state.

At step S226, the ECU 40 determines whether the value of the wear flag counter has reached at least a predetermined number of times. Upon determining that the value of the wear flag counter has reached at least the predetermined number of times (YES at step S226), the ECU 40 sets the wear flag, and stores the wear flag in, for example, the storage unit thereof. If the value of the wear flag counter has not reached at least the predetermined number of times (NO at step S226), the ECU 40 terminates the wear flag setting subroutine without setting the wear flag. After performing the wear flag setting subroutine, the ECU 40 resets the discharge counter SPC and the no-discharge NSPC to zero at step S213 of FIG. 6, thus preparing for the next cycle of the main routine. Thereafter, the ECU 40 terminates the wear determination subroutine, and returns to step S103 of the main routine.

In the wear determination subroutine, the ECU 40 can determine whether the electrodes 11 and 12 are excessively worn based on whether the gap length Lg is smaller than the threshold gap value. Specifically, the ECU 40 can acquire the actual gap length Lg in accordance with (1) The value V2*b* of the secondary voltage V2 generated based on the corresponding pulse of the determination signal IGtb (2) The discharge occurrence ratio Dr acquired at step S210

(3) The gap-discharge relationship information stored in the storage unit

For example, the ECU 40 refers to the gap-discharge relationship information illustrated in FIG. 8, and extracts, from the gap-discharge relationship information, a value of the gap length Lg corresponding to the present value V2*b* of the secondary voltage V2 and a present value of the discharge occurrence ratio Dr at step S210.

For example, when a value of the discharge occurrence ratio Dr is 80% and the present value V2*b* of the secondary voltage V2 is 2.6 kV, a value of the gap length Lg can be estimated to be approximately 0.9 mm in accordance with the gap-discharge relationship information illustrated in FIG. 8. When a value of the discharge occurrence ratio Dr is 22% and the value V2*b* of the secondary voltage V2 is 2.6 kV, a value of the gap length Lg can be estimated to be approximately 1.2 mm in accordance with the gap-discharge relationship information illustrated in FIG. 8.

Returning back to FIG. 5 after completion of the wear determination subroutine at step S102, the routine proceeds to step S103. At step S103, the ECU 40 determines whether the wear flag is set in the storage unit. Upon determining that the wear flag is set in the storage unit (YES at step S103), the ECU 40 performs, at step S104, a discharge promoting task for promoting the generation of discharges between the electrodes 11 and 12.

For example, the ECU 40 can perform, as the discharge promoting task, a task of reducing an EGR ratio as a function of the discharge occurrence ratio Dr and the gap length Lg as engine control, and a task of changing the ignition timing for each combustion cycle as a function of the discharge occurrence ratio Dr and the gap length Lg.

Figure 9:
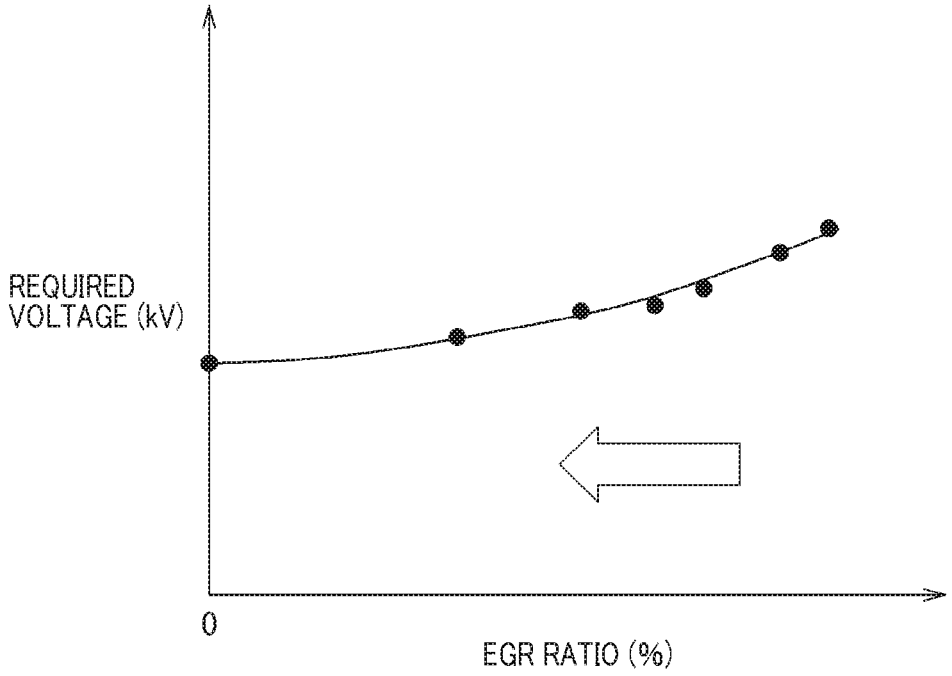
FIG. 9 is a graph schematically illustrating an example of the relationship between an EGR ratio and a required voltage.

In the combustion system of the present embodiment, a part of the exhaust gas from the engine is recirculated to the intake air as EGR gas. FIG. 9 illustrates an example of the correlation between an EGR ratio and a required voltage. The EGR ratio refers to a ratio of the EGR gas contained in the intake air flowing into the combustion chamber 200, and the required voltage refers to a discharge voltage generated when the value 2*a* of the secondary voltage V2 is applied between the electrodes 11 and 12 based on the ignition signal IGta. This correlation shows that the smaller the EGR ratio, the smaller the required voltage. That is, this correlation shows that the smaller the EGR ratio, the easier a discharge is generated between the electrodes 11 and 12. Therefore, when it is determined that the electrodes 11 and 12 are excessively worn with an increase of the gap length Lg, reducing the EGR ratio enables an environment in which a discharge is likely to occur to be created in combustion chamber 200.

Figure 10:
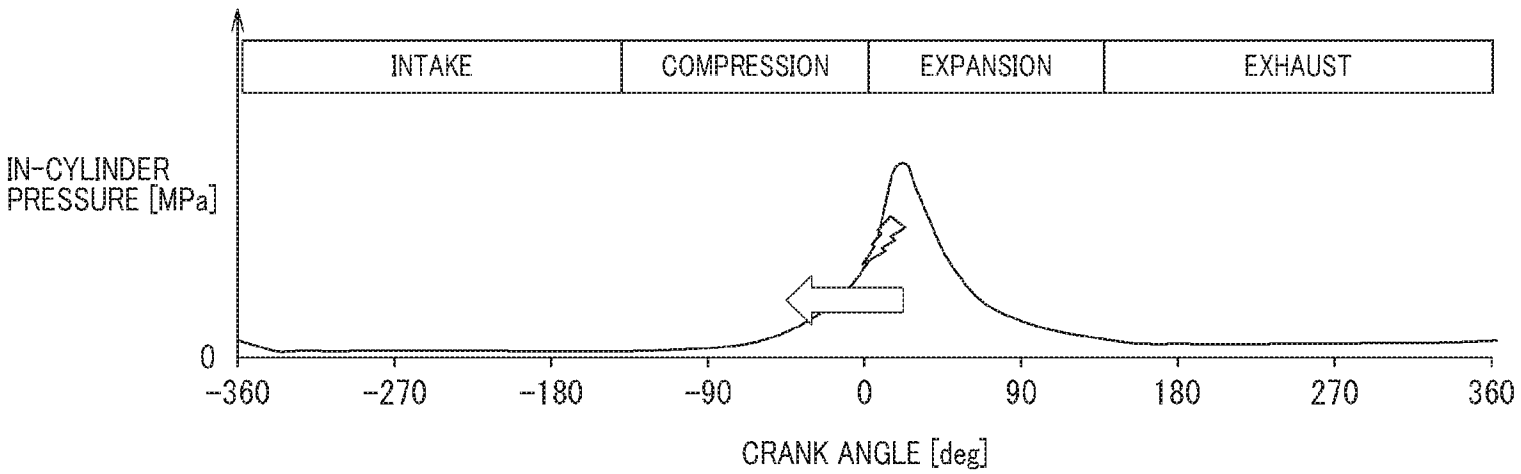
FIG. 10 is a sequential diagram schematically illustrating an example of the relationship between a crank angle and an in-cylinder pressure.

When the pressure in the combustion chamber 200 is referred to as an in-cylinder pressure, the lower the in-cylinder pressure, the easier it is for a discharge to occur between the electrodes 11 and 12. Furthermore, as shown in FIG. 10, the in-cylinder pressure varies with the crank angle in each combustion cycle. When the gas mixture is ignited before the piston moves to the top dead center TDC in the engine, the earlier the timing at which the secondary voltage is applied between the electrodes 11 and 12 based on the ignition signal IGta, the lower the in-cylinder pressure. This represents that a discharge is likely to occur between the electrodes 11 and 12 with the advanced ignition timing. For this reason, even if the electrodes 11 and 12 are excessively worn so that a discharge is less likely to occur because the gap length Lg is large, advancing the ignition timing enables a discharge to easily occur between the electrodes 11 and 12.

At step S105 of FIG. 5, the ECU 40 determines whether the ignition timing has been reached. If it is determined that the ignition timing has not been reached (NO at step S105), the ECU 40 repeats the discharge promoting routine until the ignition timing is reached. When it is determined that the ignition timing is reached (YES at step S105), the ECU 40 outputs, at step S106, the ignition signal IGta to the igniter 22 based on the information about the discharge-promoting routine performed at step S104, thereby applying the value V2*a* of the secondary voltage V2 between the electrodes 11 and 12 in response to the ignition signal IGta. This performs the ignition operation. For example, for the excessively worn electrodes 11 and 12, the ignition signal IGta is outputted according to the EGR ratio or the ignition timing corresponding to the gap length Lg. This results in, even when the electrodes 11 and 12 are excessively worn, a discharge easily occurring between the electrodes 11 and 12, making it easier to ignite the air-fuel mixture.

Otherwise, if it is determined at step S103 that the wear flag is not set in the storage unit (NO at step S103), the electrodes 11 and 12 are determined to be in the normal condition, and the routine proceeds to step S106. At step S106, the ECU 40 applies the value 2*a* of the secondary voltage V2 between the electrodes 11 and 12 based on the ignition signal IGta, to thereby perform the ignition operation. Because the electrodes 11 and 12 are in the normal condition, a discharge appropriately occurs between the electrodes 11 and 12 without the discharge-promoting routine.

The ECU 40 has a function of executing each step of the ignition control routine illustrated in FIGS. 5 to 7. The function of executing step S106 corresponds to, for example, a first execution unit and also corresponds to, for example, the ignition control unit 41, the function of executing step S205 corresponds to, for example, a second execution unit and also corresponds to, for example, the determination control unit 42, and the function of executing step S206 corresponds to, for example, a current determination unit and also corresponds to, for example, the discharge determination unit 43. The function of executing step S211 corresponds to, for example, the occurrence ratio acquisition unit, and the function of executing step S221 corresponds to, for example, the comparison section and the wear determination unit 44.

<Technical Effects>

The engine ECU 40, which includes the ignition control apparatus of the first embodiment, is configured to compare the discharge occurrence ratio Dr with the ratio threshold N for at least one of the secondary-voltage applications between the electrodes 11 and 12 based on corresponding one or more pulses of the determination signal IGtb to thereby determine whether the electrodes 11 and 12 are excessively worn based on the comparison results.

In addition, since environmental factors, such as the flow rate in the combustion chamber 200*a* are less likely to affect the number of times a discharge occurs for one or more of the secondary-voltage applications between the electrodes 11 and 12, this configuration determines whether the electrodes 11 and 12 are excessively worn with higher accuracy.

Let us consider another configuration to perform a plurality of secondary-voltage applications based on respective pulses of the determination signal IGtb over a plurality of combustion cycles. This may result in the operating condition of the engine changing for each combustion cycle. In this configuration, if the probability of the occurrence of a discharge is different for each combustion cycle, due to, for example, the pressure of the combustion chamber 200 being different for each combustion cycle, the discharge occurrence ratio Dr also differs for each combustion cycle, and as a result, the acquisition accuracy of the excessively worn state of the electrodes 11 and 12 may easily decrease.

In contrast, the engine ECU 40 of the first embodiment is configured to perform secondary-voltage applications between the electrodes 11 and 12 in each combustion cycle, making it possible to obtain the discharge occurrence ratio Dr in an environment where the likelihood of occurrence of discharge in the combustion chamber 200 does not greatly change. Therefore, the discharge occurrence ratio Dr corresponding to the excessively worn state of the electrodes 11 and 12 can be accurately obtained, and as a result, the excessively worn state of the electrodes 11 and 12 can be accurately obtained.

According to the present embodiment, one or more of secondary-voltage applications are performed based on corresponding one or more pulses of the determination signal IGtb during the intake stroke in each combustion cycle. Therefore, compared with the configuration in which the secondary-voltage applications are performed over a plurality of strokes, it is possible to suppress variations in the engine-cylinder environment during the plurality of secondary-voltage applications based on respective pulses of the determination signals IGtb. Moreover, since the secondary-voltage applications are performed in the intake stroke, when the secondary-voltage application is performed a plurality of times based on the determination signal IGtb, a plasma generated by the secondary-voltage applications is confined in the combustion chamber 200, thus preventing the plasma from flowing out of the combustion chamber 200. This results in discharges being more likely to occur between the electrodes 11 and 12, making it possible to accurately obtain the discharge occurrence ratio Dr based on the excessively worn state of the electrodes 11 and 12.

The ECU 40 of the present embodiment is configured to obtain the discharge occurrence ratio Dr for one or more of secondary-voltage applications performed based on one or more pulses of the determination signal IGtb. This configuration excludes the voltage application performed with the ignition signal IGta from the voltage application count when obtaining the discharge occurrence ratio Dr. This therefore makes it possible to prevent, due to the ignition signal IGta, a decrease in the accuracy of obtaining the discharge occurrence ratio Dr based on the determination signal IGtb.

The ECU 40 of the present embodiment is configured to determine whether the discharge occurrence ratio Dr is smaller than the ratio threshold N. This configuration enables the number of voltage applications performed based on the determination signal IGtb to increase as much as possible until the discharge occurrence ratio Dr reaches the ratio threshold N. This increases the accuracy of obtaining the discharge occurrence ratio Dr, resulting in an increase in the accuracy of determining the excessively worn state of the electrodes 11 and 12.

The ECU 40 of the present embodiment is programmed to determine whether the secondary current I2 corresponding to each pulse of the determination signal IGtb is larger than the determination current value IB. This configuration enables whether a discharge has occurred between the electrodes 11 and 12 for each of one or more voltage applications based on one or more pulses of the determination signal IGtb, resulting in an increase of the accuracy of obtaining the discharge occurrence ratio Dr.

Second Embodiment

The first embodiment acquires the discharge occurrence ratio Dr as information about the occurrence of discharges in the spark plug 10 based on the determination signal IGtb. In contrast, the second embodiment acquires the value of the discharge counter SPC, which is the number of times a discharge has occurred, as the information indicative of the occurrence of discharges in the spark plug 10. The following therefore describes the different points of the second embodiment from the first embodiment.

Figure 11:
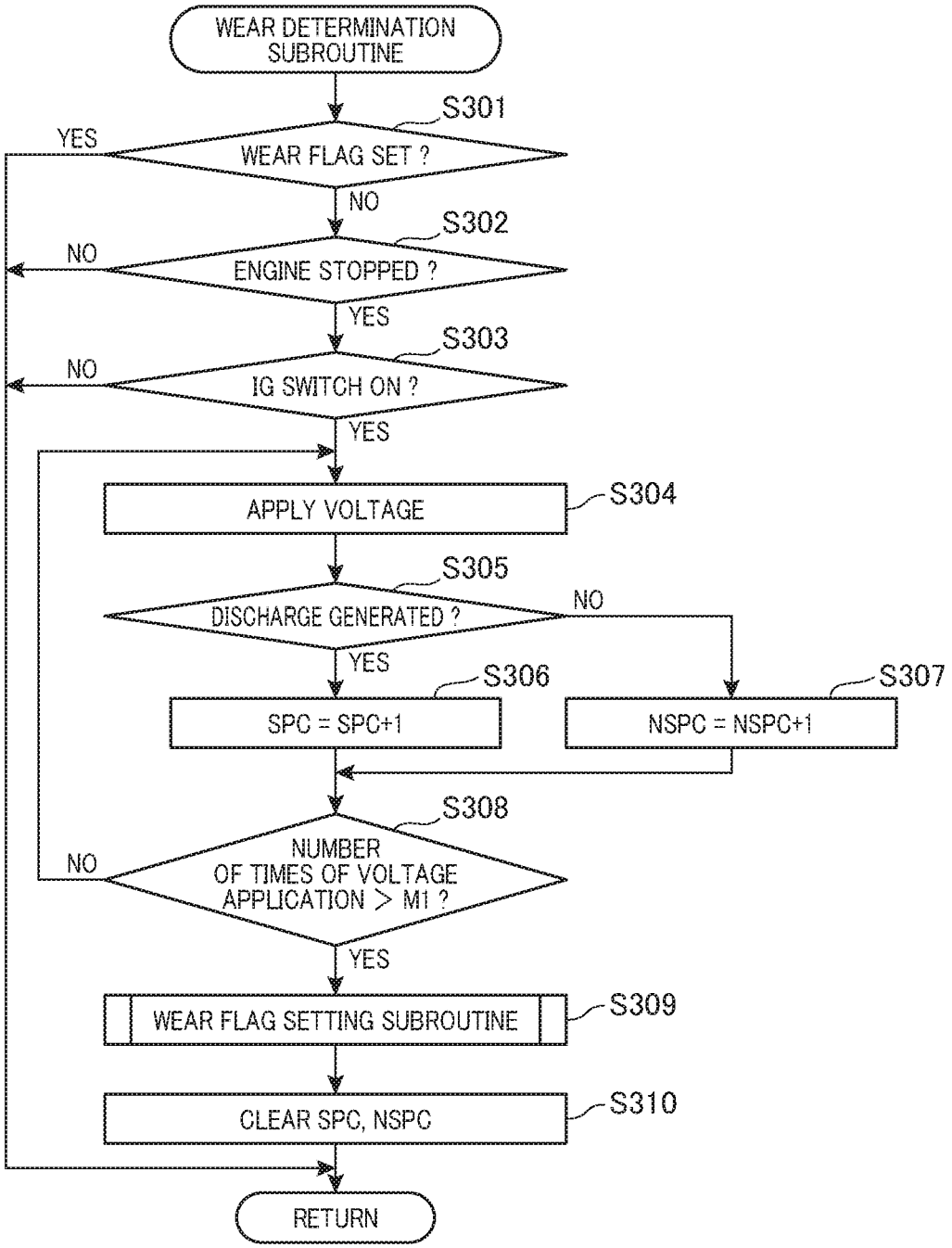
FIG. 11 is a flowchart schematically illustrating a procedure of a wear determination subroutine according to the second embodiment of the present disclosure.

Specifically, the ECU 40 is programmed to perform a wear determination subroutine illustrated in FIG. 11, which is different from the wear determination subroutine according to the first embodiment.

At step S301 of FIG. 11, the engine ECU 40 determines whether the wear flag is set, in the same manner as step S201 of the first embodiment. If the wear flag has not been set (NO at step S302), the ECU 40 determines whether the engine is stopped at step S202, and determines whether an ignition switch of the vehicle is in an on state. The ignition switch is a power switch of the vehicle, and is switchable between the on state, in which electrical power is supplied from a battery of the vehicle to components of the vehicle, and the off state, in which the power supply is shut off. For example, the situation where the engine is stopped and the ignition switch is in the on state represents a situation immediately before the engine of the parked vehicle is started, or a situation while the vehicle is stopped without idling.

If it is determined that the engine is stopped and the ignition switch is in the on state (YES at each of steps S302 and S303), the ECU 40 performs the operations at steps S304 to S307, which are the same as the respective operations at steps S205 to S208 of the first embodiment. Otherwise, if either the engine is not stopped or the ignition switch is in the off state (NO at one of steps S302 and S303), the ECU 40 terminates the routine. Note that the ECU 40 can perform the operations at steps S304 to S307 regardless of whether the ignition switch is in the on state.

At step S308, the ECU 40 acquires the voltage application count SC, which is the number of times the voltage application has been performed based on the determination signal IGtb, and determines whether the voltage application count SC is larger than a predetermined threshold application count M1. Specifically, the ECU 40 acquires the sum of the value of the discharge counter SPC and the value of the no-discharge counter NSPC as the voltage application count SC.

The ECU 40 can increment the voltage application counter each time applying the value V2*b* of the secondary voltage V2 between the electrodes 11 and 12 to thereby acquire the count value of the voltage application counter as the voltage application count SC. In this modification, the ECU 40 can delete the value of the voltage application count SC from the value of the discharge counter SPC in calculating the discharge ratio when the engine is started before the voltage application count SC reaches, for example, the threshold application count M1. The ECU 40 can be configured not to obtain the discharge ratio if the voltage application count SC remains zero.

At step S309, the ECU 40 performs a wear flag setting subroutine for determining whether to set the wear flag. The following describes the wear flag setting subroutine with reference to the flowchart of FIG. 12.

Figure 12:
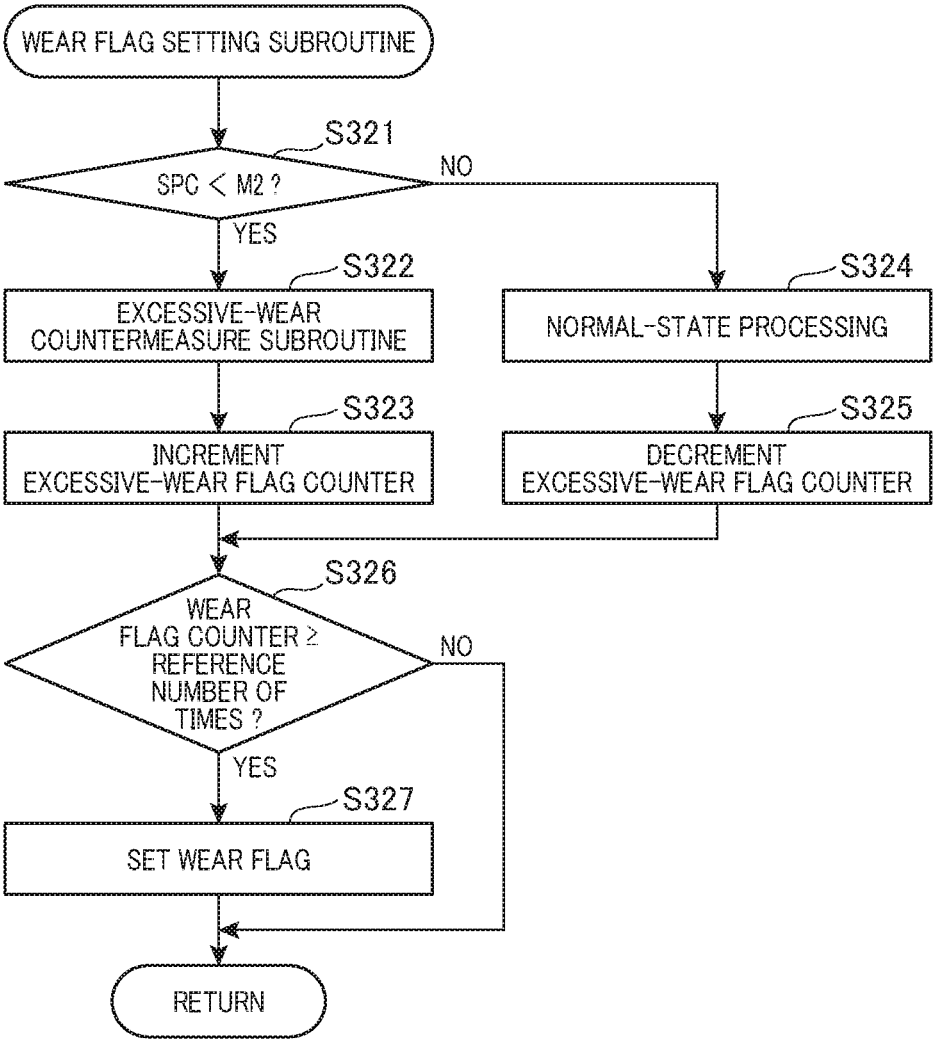
FIG. 12 is a flowchart schematically illustrating a procedure of a wear flag setting subroutine according to the second embodiment.

At step S321 of FIG. 12, the ECU 40 acquires the value of the discharge counter SPC, and determines whether the value of the discharge counter SPC is smaller than a predetermined occurrence threshold M2. The occurrence threshold M2 is a threshold for determining whether the electrodes 11 and 12 are excessively worn. Acquiring the value of the discharge counter SPC corresponds to, for example, acquiring information about the discharge occurrence situation. The occurrence threshold M2 corresponds to, for example, the discharge threshold. The occurrence threshold M2 is also referred to as a discharge occurrence count threshold M2.

When it is determined that the value of the discharge counter SPC is smaller than the occurrence threshold M2 (YES at step S321), the ECU 40 determines that the electrodes 11 and 12 are excessively worn, and performs the operations at step S322 and S323 to thereby perform, for example, increment of the wear flag counter, which are the same as the operations at steps S222 and S223 of the first embodiment.

In contrast, when it is determined that the value of the discharge counter SPC is not smaller than the occurrence threshold M2 (NO at step S321), the ECU 40 determines that the electrodes 11 and 12 are in the normal state. Then, the ECU 40 performs the operations at step S324 and S325 to thereby perform, for example, decrement of the wear flag counter, which are the same as the operations at steps S224 and S225 of the first embodiment.

At steps S326 and S327, the ECU 40 performs the operations at step S326 and S327, which are identical to the operations in steps S226 and S227, to thereby perform (1) Determination of whether the value of the wear flag counter has reached at least the predetermined number of times (2) Setting of the wear flag As described above, the engine ECU 40 of the second embodiment is configured to perform secondary-voltage applications between the electrodes 11 and 12 while the engine is stopped, making it possible to obtain the value of the discharge counter SPC as a generatability of discharges between the electrodes 11 and 12 in the combustion chamber 200 where no flow of the mixed air, no temperature change, and no pressure change occur. This configuration therefore prevents difficulty in discharges occurring between the electrodes 11 and 12 in the combustion chamber 200 due to the internal environment of the combustion chamber 200, making it possible to accurately obtain the value of the discharge counter SPC with greater accuracy. This therefore enables whether the electrodes 11 and 12 are excessively worn to be determined with greater accuracy. Note that the second embodiment can determine whether the electrodes 11 and 12 are excessively worn in accordance with comparison between the discharge occurrence ratio Dr and the ratio threshold N.

Third Embodiment

The ignition circuit 20 of the first embodiment is configured as an induction discharge circuit for generating induction discharges in the spark plug 10.

In contrast, the ignition circuit 20 of the third embodiment is configured as a capacitive discharge circuit for generating capacitive discharges in the spark plug 10. The following therefore describes the different points of the third embodiment from the first embodiment.

The ignition circuit 20 performs capacitor discharge ignition (CDI) of the spark plug 10.

Figure 13:
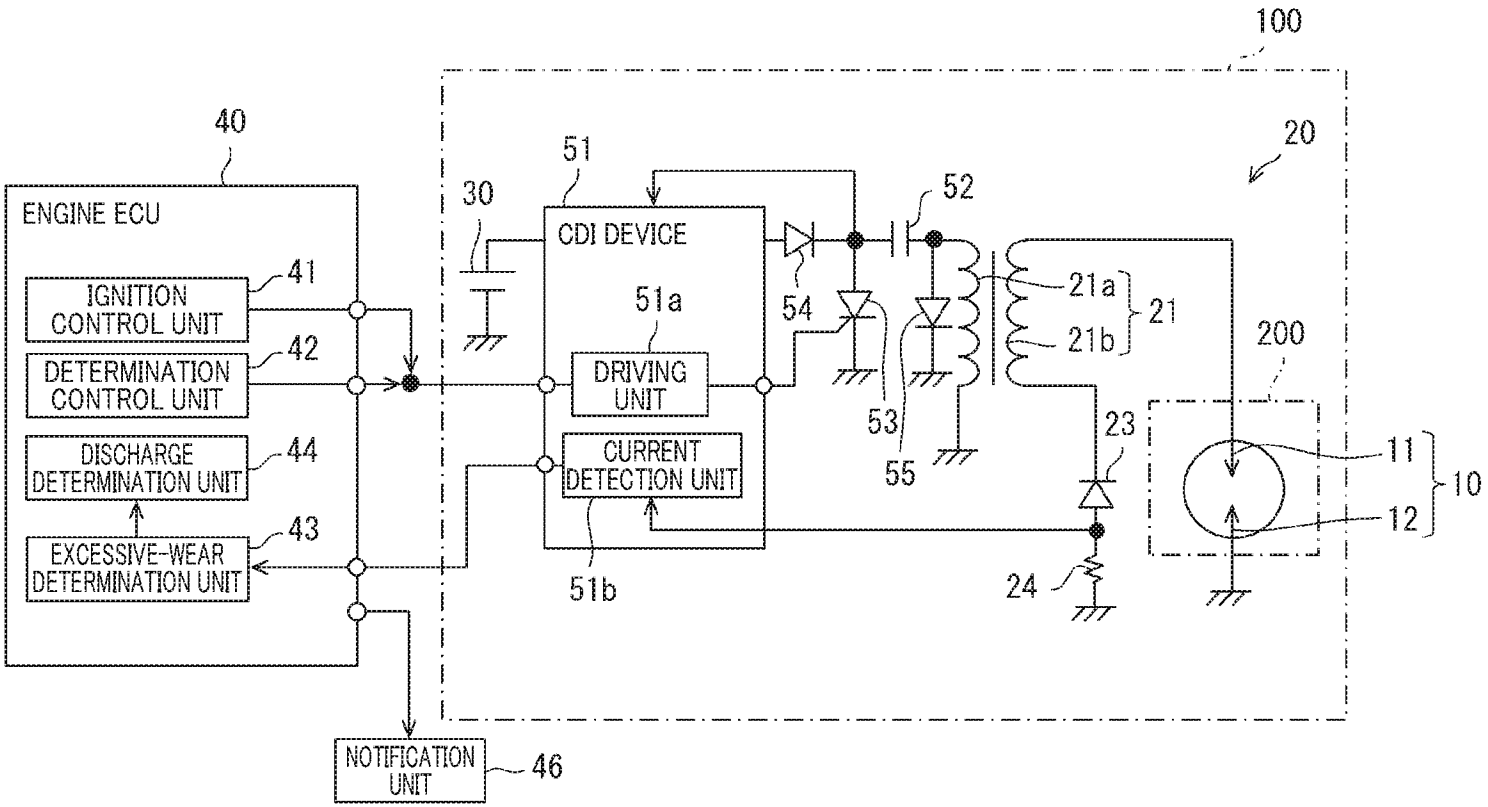
FIG. 13 is a circuit block diagram schematically illustrating an example of the configuration of an ignition apparatus according to the third embodiment of the present disclosure.

As shown in FIG. 13, the ignition circuit 20 includes a CDI device 51 provided instead of the igniter 22 of the first embodiment, a capacitor 52 as a power storage section, a thyristor 53 serving as a switching element, and diodes 54 and 55.

The CDI device 51 includes a booster, such as a converter (not shown), and is connected to the CDI device 51 via the capacitor 52 and the diode 54, and the CDI device 51 is connected to the battery 30. The booster is configured to boost the power supply voltage of the battery 30, thus storing a desired level of charge in the capacitor 52.

The CDI device 51 also includes a driving unit 51*a* and a current detection unit 51*b* similar to the respective driving unit 22*b* and current detection unit 22*c* of the first embodiment. The diode 55 is connected to the capacitor 52 in parallel with the primary coil 21*a*. The anode of the thyristor 53 is connected to the capacitor 52 and the diode 54, and the cathode of the thyristor 53 is connected to the second common signal ground. The gate of the thyristor 53 is connected to the driving unit 51*a*.

This configuration enables the electric power of the battery 30 boosted by the booster of the CDI device 51 to be stored in the capacitor 52 while the thyristor 53 is in an off state. Then, the ECU 40 inputs a command signal to the gate of the thyristor 53 via the drive unit 51*a*, so that the thyristor 53 is turned on. The on-state thyristor 53 enables the electrical charge stored in the capacitor 52 to be discharged from the capacitor 52 into the primary coil 21*a*. This enables a higher secondary voltage V2 to be induced actor the secondary coi8l 21*b*, making it possible to generate a capacitor discharge between the electrodes 11 and 12 of the spark plug 10.

The ECU 40 controls the electric charge stored in the capacitor 52 based on the boosted voltage boosted by the booster. This control enables low values V2*b* of the secondary voltages V2 to be generated between the electrodes 11 and 12 a predetermined number of times, which is similar to the configuration of the ECU 10 of the first embodiment.

Other Embodiments

The present disclosure should not be construed as being limited to the abovementioned embodiments. The present disclosure can be therefore applied to other various embodiments and their combinations within the scope of the present disclosure.

The ECU 40 of the first modification is configured to apply the secondary voltage V2 based on the determination signal IGtb between the electrodes 11 and 12 one or more times during the exhaust stroke or the compression stroke, which is different from the intake stroke, in each combustion cycle. The ECU 40 can also be configured to perform the secondary voltage V2 between the electrodes 11 and 12 a plurality of times astride several strokes in each combustion cycle. For example, the ECU 40 can perform, in each combustion cycle, some of voltage applications based on the determination signal IGtb in the exhaust stroke, and the remaining voltage applications based on the determination signal IGtb in the intake stroke.

The ECU 40 of the second modification is configured to perform at least one secondary voltage application based on the determination signal IGtb in each of a plurality of combustion cycles. The ECU 40 of the second modification is configured to obtain the discharge occurrence ratio Dr in accordance with plural secondary-voltage applications based on the determination signal IGtb during the plurality of combustion cycles.

For example, the ECU 40 of the second modification is configured to perform at least one secondary voltage application based on the determination signal IGtb during a specified stroke, such as the intake stroke, in each of the plurality of combustion cycles. This configuration also enables the discharge occurrence ratio Dr to be obtained for the plurality of voltage applications performed over the plurality of combustion cycles.

The ECU 40 of the third modification is configured to (1) Perform a plurality of secondary-voltage applications based on the determination signals IGtb (2) Obtain the number of secondary-voltage applications required for a discharge to occur between the electrodes 11 and 12

(3) Determine whether the electrodes 11 and 12 are excessively worn based on the obtained number of secondary-voltage applications A relatively larger gap length Lg of the gap due to some degree of wear of the electrodes 11 and 12 may cause plasma to be generated in the combustion chamber 200, so that there are a certain number of free electrons in the combustion chamber 200. This may result in a discharge being likely to occur in the combustion chamber 200. From this viewpoint, the ECU 40 is configured to determine the excessively worn state of the electrodes 11 and 12 based on a correlative relationship among the number of times of a voltage application required until a discharge occurs between the electrodes 11 and 12, the gap length Lg, and the secondary voltage V2.

The ECU 40 of the fourth modification is configured to determine whether a discharge has occurred between the electrodes 11 and 12 in accordance with an integrated value of the secondary current I2. The secondary current I2 is generated when a discharge occurs between the electrodes 11 and 12, but is not generated when no discharge occurs between the electrodes 11 and 12. This results in the integrated value of the secondary current I2 at a first discharge occurrence ratio differing from the integrated value of the secondary current I2 at a second discharge occurrence ratio different from the first discharge occurrence ratio.

From this viewpoint, the ECU 40 of the fourth modification is configured to calculate the integrated value of the secondary current I2, and compare the integrated value of the secondary current I2 with a predetermined current threshold, making it possible to detect the discharge occurrence ratio based on the comparison result.

The ECU 40 of the fifth modification is configured to use the primary voltage V1 or the secondary voltage V2 as a determination parameter for determining whether a discharge has occurred between the electrodes 11 and 12.

For example, the ECU 40 of the fifth modification is configured to determine whether the primary voltage V1 becomes larger than a predetermined primary voltage threshold when the secondary voltage V2 is applied between the electrodes 11 and 12 based on the determination signal IGtb. This configuration uses the primary voltage V1, which is lower than the secondary voltage V2, as the determination parameter, making it possible to easily construct a simpler circuit for determining whether the primary voltage V1 becomes larger than the predetermined primary voltage threshold. The ignition circuit 20 is able to directly detect the primary voltage V1, eliminating the need of providing the detection resistor 24 for detecting the secondary current I2.

In addition, the ECU 40 of the fifth modification can also be configured to determine whether the secondary voltage V2 becomes larger than a predetermined secondary voltage threshold VB when the secondary voltage V2 is applied between the electrodes 11 and 12 based on the determination signal IGtb. This configuration makes it possible to determine that no discharge has occurred between the electrodes 11 and 12 when the secondary voltage V2 is larger than the secondary voltage threshold VB. This configuration makes it possible to directly detect the secondary voltage V2, resulting in the accuracy of deterring whether a discharge has occurred being higher.

The ECU 40 of the sixth modification is configured to perform secondary-voltage applications based on the determination signal IGtb during selectively one of a first application period of the intake stroke, a second application period of the exhaust stroke, a third application period prior to staring of the engine, and a fourth application period after starting of the engine. The ECU 40 of the sixth modification can also be configured to previously determine, for each of the first to fourth application periods, the discharge ratio in accordance with voltage application conditions that are determined based on the corresponding period. For example, the ECU 40 is configured to determine the secondary voltage V2, the ratio threshold N, and the energization duration for the primary coil 21*a* individually for each of the first to fourth application periods.

This configuration makes it possible to adjust, even if a discharge voltage at which a discharge occurs between the electrodes 11 and 12 changes depending on the operating state of the engine, such as the engine speed or the engine load, the voltage application conditions that are suitable for the changed discharge voltage. This therefore enables whether the electrodes 11 and 12 are excessively worn to be accurately determined.

The ECU 40 of the seventh modification is configured to perform statistical processing of at least one of (1) Determination of whether the secondary current I2 flows (2) Acquisition of the discharge occurrence ratio Dr (3) Estimation of the gap length Lg For example, when a secondary-voltage application is performed a plurality of times in one combustion cycle, the ECU 40 is configured to perform statistical processing of samples of the discharge ratio Dr calculated for the respective combustion cycles, such as calculation of an average of the samples of the discharge ratio Dr as a finally determined value of the discharge ratio Dr, or calculation of the variance of the samples of the discharge ratio Dr as a finally determined value of the discharge ratio Dr.

When performing one secondary voltage application in each combustion cycle, the ECU 40 is configured to obtain a sample of the discharge occurrence ratio Dr for each combustion cycle, and perform statistical processing of the samples of the discharge occurrence ratio Dr respectively calculated for the combustion cycles, such as calculation of an average based on the samples of the discharge occurrence ratio Dr or calculation of the variance of the samples of the discharge occurrence ratio Dr. Thus, it is possible to reduce an error, which is included in the finally determined value of the discharge occurrence ratio Dr and caused by variations in the discharge operations calculated for the respective combustion cycles.

The ECU 40 of the eighth modification is configured to acquire the gap length Lg as a parameter indicating the excessively worn state of the electrodes 11 and 12.

Additionally, the ECU 40 is configured to (1) Obtain a discharge occurrence/non-occurrence data sample indicative of whether a discharge has occurred for each of a plurality of secondary-voltage applications (2) Weight the obtained discharge occurrence/non-occurrence data samples in accordance with, for example, respective crank angles of the engine (3) Obtain the gap length Lg based on the weighted discharge occurrence/non-occurrence data samples of the gap length Lg using, for example, gap-distance relationship information, which is similar to the gap-discharge relationship information illustrated in FIG. 8; the relationship includes a relationship among the discharge occurrence/non-occurrence data, the secondary voltage V2, and the gap length Lg Similarly, when obtaining the gap length Lg during a selected stroke in one combustion cycle, the ECU 40 is configured to (1) Obtain the number of discharge occurrences during the first previous stroke closest to the selected stroke or during the second previous which is next closest to the selected stroke (2) Obtain the gap length Lg based on the number of discharge occurrences during the first previous stroke or during the second previous stroke using, for example, gap-distance relationship information, which is similar to the gap-discharge relationship information illustrated in FIG. 8; the relationship includes a relationship among the number of discharge occurrences, the secondary voltage V2, and the gap length Lg The engine ECU 40 of the ninth modification is configured to acquire the wear state of the electrodes 11 and 12 in a plurality of stages. For example, a plurality of ratio thresholds are set for the discharge occurrence ratio Dr, and the engine ECU 40 stepwisely acquires information indicative of a decrease in the discharge occurrence ratio Dr each time the discharge occurrence ratio Dr becomes smaller than a corresponding one of the ratio thresholds. That is, the engine ECU 40 stepwisely acquires information indicative of expansion in the gap length Lg due to wear of the electrodes 11 and 12 each time the discharge occurrence ratio Dr becomes smaller than a corresponding one of the ratio thresholds.

This configuration enables the detail of each of the engine control, the ignition control, and the notification control to be individually determined in accordance with how the discharge occurrence ratio Dr decreases. This configuration also enables each of the engine control, the ignition control, and the notification control to be adjusted to automatically follow decrease in the discharge occurrence ratio Dr. For example, when the amount of decrease in the discharge occurrence ratio Dr is small, the engine control and/or the ignition control are performed. When the amount of decrease in the discharge occurrence ratio Dr is large, the notification control is performed to finally notify users of the plug replacement timing. Note that the ignition apparatus 100 of the ignition system S can be configured to control the secondary current I2, and acquire the wear state of the electrodes 11 and 12 in a plurality of stages. This configuration enables original components of the ignition apparatus 100 to acquire the wear state of the electrodes 11 and 12 in a plurality of stages in addition to controlling the secondary current I2, thus reducing in size the ignition system S.

The ECU 40 of the tenth modification is configured to use, instead of a pulse signal as the determination signal IGtb, a sinusoidal alternating-current (AC) signal having a frequency within the range from several kHz to several tens of kHz inclusive as the determination signal IGtb. This configuration switches the switching section 22*a* between the on state and the off state at the frequency within the range from several kHz to several tens of kHz inclusive. This configuration, which cyclically turns on and off the switching section 22*a* at the frequency within the range from several kHz to several tens of kHz inclusive, enables the secondary voltage V2 applied, through a transformer comprised of the primary and secondary coils 21*a* and 21*b*, between the electrodes 11 and 12 to substantially become a sinusoidal AC voltage with the frequency within the range from several kHz to several tens of kHz. This therefore makes it possible to apply, as the secondary voltage V2 based on the determination signals IGtb, the sinusoidal AC voltage having the frequency within the range from several kHz to several tens of kHz between the electrodes 11 and 12, thus easily increasing the number of determinations of whether the electrodes 11 and 12 are excessively worn. Note that, when the ECU 40 performs a secondary-voltage application based on the sinusoidal AC signal as the determination signals IGtb, a delay time may occur until the secondary voltage V2 reaches a predetermined voltage immediately after application of the secondary voltage V2. This may result in the discharge ratio obtained based on the gap G immediately after application of the secondary voltage V2 containing a large error. For addressing such an issue, the ECU 40 of the tenth modification can be configured to wait for a predetermined period of time, such as several milliseconds, after the secondary-voltage application, and obtain the discharge ratio after the waiting.

In each of the first to third embodiments, the ECU 40 including the ignition control apparatus serves as the ignition control apparatus according to the present disclosure, but the eleventh embodiment is configured such that the ignition control apparatus is installed in the ignition apparatus 100. For example, the discharge determination unit 43 and the wear determination unit 44 are integrally provided to the ignition coil 21 or the igniter 22 of the ignition apparatus 100. For example, the ignition apparatus 100, which incorporates the wear determination unit 44 integrated with, for example, the current detection unit 22*c*, enables the passage through which the secondary current I2 flows to be shorter, thus lowering the influence of noise on the secondary current I2. In addition, integrally installing the ignition control apparatus according to the present disclosure into the ignition apparatus 100 enables the ignition apparatus 100 and the engine ECU 40 to be downsized.

Both the engine ECU 40 and the ignition apparatus 100 can constitute a control unit as the ignition control device according to the present disclosure. For example, the igniter 22 of the ignition apparatus 100 can be configured to generate the determination signal IGtb including pulses, and the ECU 40 can be configured to output, to the driving unit 22*b*, the command signals for determining the application duration and timing of each pulse of the determination signal IGtb to the driving unit 22.

In the twelfth modification, one or more various processors installed in the vehicle except for the ECU 40 can constitute the ignition control device according to the present disclosure, and the various processors are cooperatively linked to each other to serve as the ignition control device according to the present disclosure. Various programs can be stored in a non-transitory tangible storage medium, such as a flash memory or a hard disk, provided in or accessible by each of the processors. Instructions of at least one program stored in each of the processors can cause the corresponding one of the processors to perform at least one allocated function, and all the allocated functions in the processors constitute the ignition control device according to the present disclosure.

The ECU 40 of each embodiment is configured to decrement the wear flag counter upon determining that the discharge occurrence ratio Dr is not smaller than the ratio threshold N, that is, determining that the electrodes 11 and 12 are in the normal state. The ECU 40 of the thirteenth modification however is configured to clear the wear flag counter, and increment the wear flag counter in a normal state mode after performing the predetermined normal task. The ECU 40 of each embodiment is configured not to clear the wear flag by the wear determination subroutine, but the ECU 40 of the thirteenth modification can be configured to clear the wear flag each time power supply to the ignition system S is shut off, the engine is shut down, or a predetermined period of time has elapsed since setting of the wear flag.

While the illustrative embodiments and their modifications of the present disclosure have been described herein, the present disclosure is not limited to the embodiments and their modifications described herein. Specifically, the present disclosure includes any and all embodiments having modifications, omissions, combinations (e.g., of aspects across various embodiments), adaptations and/or alternations as would be appreciated by those in the art based on the present disclosure. The limitations in the claims are to be interpreted broadly based on the language employed in the claims and not limited to examples described in the present specification or during the prosecution of the application, which examples are to be construed as non-exclusive.

What is claimed is:

1. An ignition control device for controlling operation of an ignition apparatus, the ignition control device comprising:

an ignition section that has first and second electrodes disposed in a combustion chamber of an internal combustion engine, a voltage application between the first and second electrodes enabling a discharge to be generated between the first and second electrodes for igniting a gas mixture in the combustion chamber;

voltage application circuitry configured to perform at least one application of a determination voltage between the first and second electrodes; and an ECU, comprising a computer, the ECU being configured to:

acquire a discharge occurrence ratio at the ignition section for the at least one application of the determination voltage; and compare the acquired discharge occurrence ratio with a predetermined determination threshold to thereby determine a degree of wear of at least one of the first and second electrodes.

2. The ignition control device according to claim 1, wherein:

the voltage application circuitry is configured to perform the at least one application of the determination voltage between the first and second electrodes during a combustion cycle of the internal combustion engine; and the ECU is further configured to acquire the discharge occurrence ratio for the one combustion cycle.

3. The ignition control device according to claim 1, wherein:

the voltage application circuitry is further configured to perform the at least one application of the determination voltage between the first and second electrodes during one stroke of one cycle of the internal combustion engine; and the ECU is further configured to acquire the discharge occurrence ratio for the one stroke of the combustion cycle.

4. The ignition control device according to claim 3, wherein the one stroke is an exhaust stroke or an intake stroke of the internal combustion engine.

5. The ignition control device according to claim 1, wherein the ECU is further configured to:

perform a first execution step that causes the voltage application circuitry to apply a discharging voltage between the first and second electrodes to thereby generate a discharge between the first and second electrodes;

perform a second execution step that causes the voltage application circuitry to perform the at least one application of the determination voltage between the first and second electrodes to thereby acquire the discharge occurrence ratio; and acquire the discharge occurrence ratio for the at least one application of the determination voltage by performance of the second execution step via the voltage application circuitry.

6. The ignition control device according to claim 5, wherein:

performance of the second execution step causes the voltage application circuitry to apply the determination voltage between the first and second electrodes one or more times while the internal combustion engine is stopped.

7. The ignition control device according to claim 5, wherein:

performance of the second execution step causes the voltage application circuitry to perform the at least one application of the determination voltage during a predetermined stroke in each of a plurality of the combustion cycles of the internal combustion engine.

8. The ignition control device according to claim 1, wherein:

the ECU is further configured configured to determine whether the acquired discharge occurrence ratio is smaller than the predetermined determination threshold.

9. The ignition control device according to claim 1, wherein:

the ECU is further configured to perform a determination of whether a current flowing through the first and second electrodes has reached a predetermined threshold current based on the at least one application of the determination voltage performed by the voltage application circuitry; and the ECU is further configured to perform acquire the discharge occurrence ratio based on a result of the performed determination of whether the current flowing through the first and second electrodes has reached the predetermined threshold current.

10. The ignition control device according to claim 1, wherein the discharge occurrence ratio is a ratio of the number of times of discharge occurs to the number of applications of the determination voltage between the first and second electrodes.

11. The ignition control device according to claim 1, wherein the ECU is further configured to compare a current value generated by each application of a value of the determination voltage with a current determination threshold to thereby acquire the discharge occurrence ratio.

12. The ignition control device according to claim 1, wherein:

the discharge occurrence ratio is a ratio of the number of times of discharge occurs to the number of applications of the determination voltage between the first and second electrodes; and the ECU is further configured to compare a current value generated by each application of a value of the determination voltage with the determination threshold to thereby acquire the discharge occurrence ratio.

* * * * *